US010604367B2

(12) United States Patent
Tsujimoto

(10) Patent No.: US 10,604,367 B2
(45) Date of Patent: Mar. 31, 2020

(54) METHOD AND DEVICE FOR CUTTING OUTER LAYER OF ROLLSTOCK

(71) Applicant: ZUIKO CORPORATION, Osaka (JP)

(72) Inventor: Yoshiaki Tsujimoto, Osaka (JP)

(73) Assignee: ZUIKO CORPORATION, Osaka (JP)

( * ) Notice: Subject to any disclaimer, the term of this patent is extended or adjusted under 35 U.S.C. 154(b) by 0 days.

(21) Appl. No.: 16/090,813

(22) PCT Filed: Apr. 13, 2017

(86) PCT No.: PCT/JP2017/015113
§ 371 (c)(1),
(2) Date: Oct. 2, 2018

(87) PCT Pub. No.: WO2017/183553
PCT Pub. Date: Oct. 26, 2017

(65) Prior Publication Data

US 2019/0092596 A1 Mar. 28, 2019

(30) Foreign Application Priority Data

Apr. 18, 2016 (JP) ..... 2016-082653

(51) Int. Cl.
*B65H 19/10* (2006.01)
*B65H 35/04* (2006.01)
(Continued)

(52) U.S. Cl.
CPC ..... *B65H 19/105* (2013.01); *B26D 1/04* (2013.01); *B26D 3/00* (2013.01); *B26D 7/08* (2013.01); *B65H 35/04* (2013.01)

(58) Field of Classification Search
CPC ..... B65H 19/105; B65H 35/04; B26D 3/00; B26D 7/08
See application file for complete search history.

(56) References Cited

U.S. PATENT DOCUMENTS 6,339,982 B1 * 1/2002 Angel ..... B26D 1/025 400/621
6,994,408 B1 * 2/2006 Bunnell ..... B65H 35/0006 312/34.8
(Continued)

FOREIGN PATENT DOCUMENTS

JP H04-44940 A 2/1992
JP H04-49152 A 2/1992
(Continued)

OTHER PUBLICATIONS

International Search Report Issued in PCT/JP2017/015113 dated Jul. 11, 2017.

*Primary Examiner* — Omar Flores Sanchez
(74) *Attorney, Agent, or Firm* — Renner, Otto, Boisselle & Sklar, LLP

(57) ABSTRACT

A method for cutting at least an outermost film of rollstock across a width direction of a film, the rollstock formed by a film sheet rolled from base end to tip end, the method including: separation step of generating a gap between the inner peripheral film and the outer layer by separating first edge portion of the outer layer from the inner peripheral film in a radial direction of the rollstock, in a state where the outer layer is remained to be rolled as a part of the rollstock; step of displacing a portion of the outer layer defining the gap in a first width direction from the first edge portion to second edge portion in the width direction; and step of cutting the outer layer across the width direction during the displacement step, while the first cutter is moved from the first edge portion to the second edge portion.

13 Claims, 15 Drawing Sheets

(51) Int. Cl.

| | |
|---|---|
| ***B26D 7/08*** | (2006.01) |
| ***B26D 1/04*** | (2006.01) |
| ***B26D 3/00*** | (2006.01) |

(56) References Cited

U.S. PATENT DOCUMENTS

| | | | | |
|---|---|---|---|---|
| 7,406,901 | B2 * | 8/2008 | Schmidt | B65H 19/26 242/527.2 |
| 8,002,928 | B2 * | 8/2011 | Nakakado | A61F 13/15593 156/229 |
| 2007/0227673 | A1 * | 10/2007 | Kameda | B65H 19/105 156/502 |
| 2008/0134635 | A1 * | 6/2008 | Johnson | B65B 25/146 53/203 |
| 2011/0196331 | A1 * | 8/2011 | Nakakado | A61F 13/15593 604/385.01 |
| 2011/0212818 | A1 * | 9/2011 | Nakakado | A61F 13/15593 493/454 |
| 2015/0121985 | A1 * | 5/2015 | Nunota | B65H 16/08 72/324 |
| 2017/0009398 | A1 * | 1/2017 | Caspar | B24C 1/045 |
| 2017/0137248 | A1 * | 5/2017 | Sato | B65H 19/18 |
| 2018/0155143 | A1 * | 6/2018 | Wimmer | B65H 19/102 |
| 2018/0257408 | A1 * | 9/2018 | Eiyama | B65H 16/021 |

FOREIGN PATENT DOCUMENTS

| | | | |
|---|---|---|---|
| JP | H06-81915 | U | 11/1994 |
| JP | H08-40426 | A | 2/1996 |
| JP | H08-113399 | A | 5/1996 |
| JP | H08-231090 | A | 9/1996 |

* cited by examiner

Fig. 12A
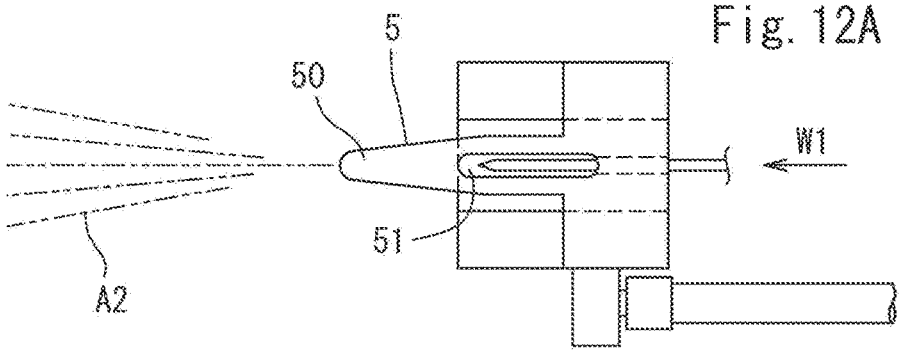
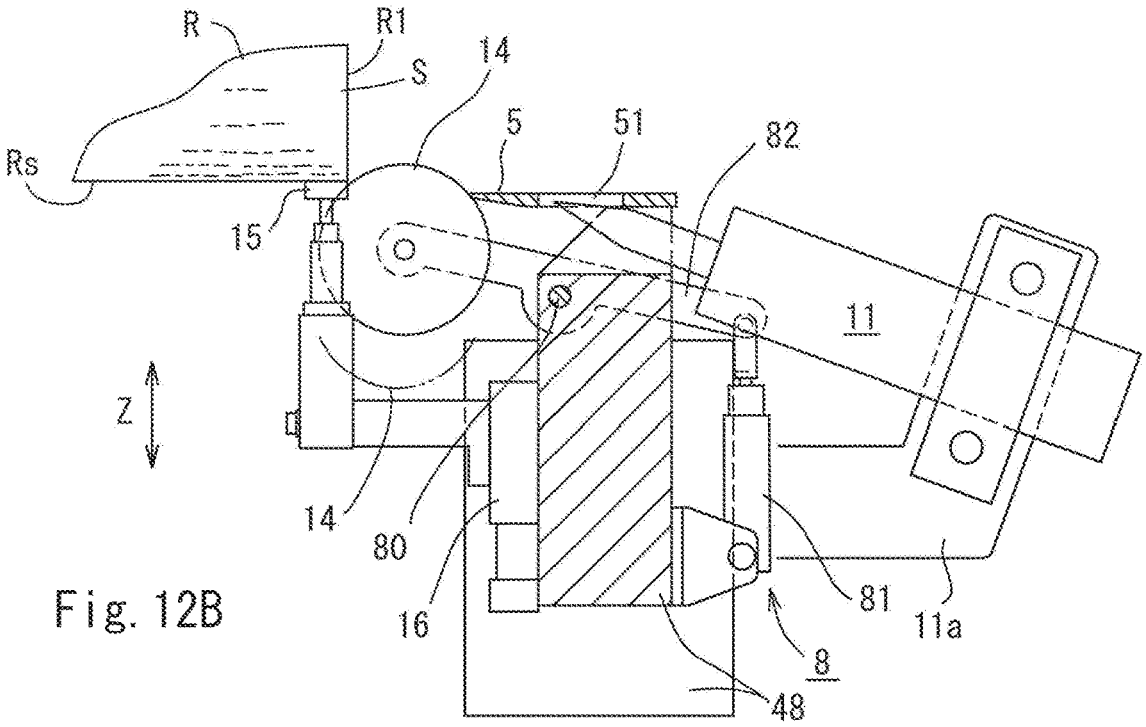
Fig. 12B
Fig. 12C
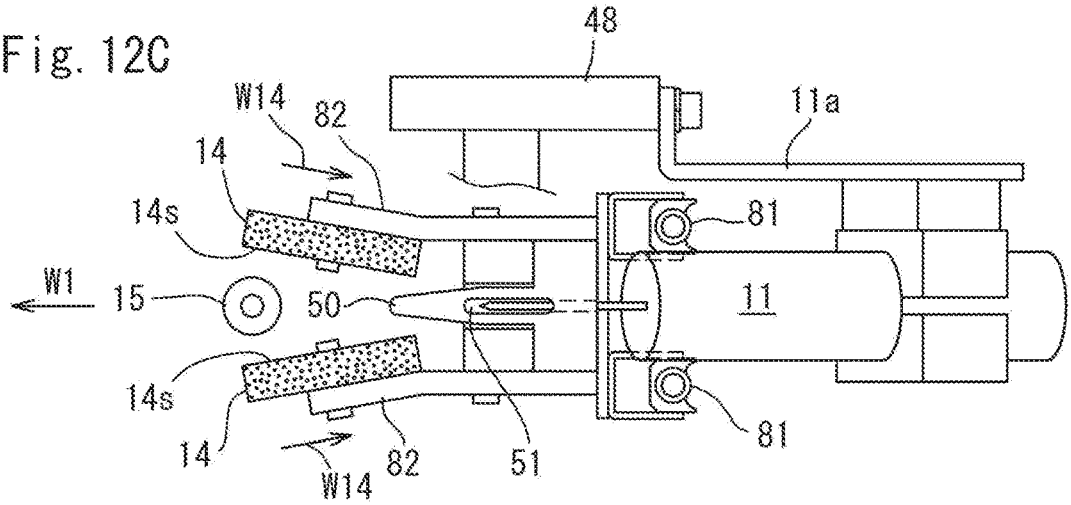

METHOD AND DEVICE FOR CUTTING OUTER LAYER OF ROLLSTOCK

TECHNICAL FIELD

The present invention relates to a method and device for cutting an outer layer of a rollstock in which a film such as a resin film or a nonwoven fabric is rolled (wound) in a roll shape.

BACKGROUND ART

Many materials of disposable wearable articles such as, for example, paper diapers or sanitary napkins are sheet-like materials obtained by cutting a rollstock. When such sheet-like materials are produced, a film is wound off from the rollstock. A portion of an outermost layer of a length of one round in the outermost circumference of the rollstock is easy to be soiled or damaged during transportation, and therefore, needs to be removed.

CITATION LIST

Patent Literature

[Patent Literature 1] Japanese Patent Application Publication No. 08-40426 (Abstract)

[Patent Literature 2] Japanese Patent Application Publication No. 08-113399 (FIG. 1)

[Patent Literature 3] Japanese Patent Application Publication No. 04-44940 (FIG. 14)

[Patent Literature 4] Japanese Utility Model Application Publication No. 06-81915 (Abstract)

SUMMARY OF INVENTION

Processing of the article described above is generally fully automatically performed, which results in productivity improvement. However, the patent literatures described above do not disclose a method for cutting an outer layer of the film formed of a resin film or a non-woven fabric.

Thus, an object of the present invention is to provide a method and a device for cutting an outer layer of a rollstock, which contribute to automation.

The method of the present invention is a method for cutting at least an outermost film S of a rollstock R, the rollstock R formed by rolling a film S from a base end Sb of the film S to a tip end Se of the film S, the film S being cut across an overall width in a width direction W of the film S, the method including:

a separation step of separating a first edge portion R1 of an outer layer Rs at an edge in the width direction W from an inner peripheral film S of the rollstock R under the outer layer Rs, wherein the separation step is carried out in a radial direction Z of the rollstock R in a state where the outer layer Rs composing the outermost film S of the rollstock R remains to be rolled as a part of the rollstock R, thereby producing a gap (an air gap) Δ between the outer layer Rs and the inner peripheral film S;

a displacement step of displacing a portion of the outer layer Rs, the portion corresponding to the gap Δ, and the portion being displaced in a first width direction W1 heading from the first edge portion R1 to a second edge portion R2 of the outer layer Rs at an edge in the width direction W; and a cutting step of cutting the outer layer Rs across the overall width of the width direction W during the displacement step by moving a first cutter 11 from the first edge portion R1 to the second edge portion R2.

According to the present method invention, the air gap Δ is formed, in the separation step, between the outer layer Rs and a film S placed in the inner circumferential side of the outer layer Rs, and then the portion of the outer layer Rs corresponding to the air gap Δ is displaced (moved) in the first width direction W1. Accordingly, the first cutter 11 moves in the first width direction W1 so that the separated outer layer Rs can be cut, and thereby, automation of the cutting can be performed.

In the present invention, the air gap Δ produced (generated) between the outer layer Rs and the inner peripheral film under the outer layer Rs refers to a gap generated in a surface layer portion of the rollstock. The surface layer includes the outermost layer and a second or more layers under (in the inside of) the outermost layer, and refers to the outermost layer and a layer close to the outermost layer forming the gap.

That is, the air gap Δ may be generated by separating only the outermost layer from the film in a further inner circumferential side than the outermost layer, or the air gap Δ may be generated by separating two or more layers of the outer circumferential side layers including the outermost layer, from the layer in a further inner circumferential side than the layers of the outer circumferential side.

For example, only the film (the outermost layer) in the outermost circumference may be separated from a film of the second layer directly under the outermost layer (i.e., the second from the outermost circumference) in the radial direction, so that the air gap Δ is generated between the outermost layer and the film of the second layer. On the other hand, a two-layer film including the outermost layer (the outermost layer and the film of the second layer from the outermost circumference) may be separated from a film of the third layer (i.e., the third from the outermost circumference) in the radial direction, and the air gap Δ may be generated between the two-layer film and the film of the third layer.

In a first aspect, a device of the present invention is a device that cuts an outer layer Rs composing at least an outermost film S of a rollstock R, the rollstock R formed by rolling a film S from a base end Sb of the film S to a tip end Se of the film S, the film S having a flexibility in a length direction, the outer layer Rs being cut across an overall width of a width direction W of the film S, the device including:

a pair of engaging rollers 14 of which side surfaces 14*s* are arranged by being spaced apart (separated) from each other in a circumferential direction of the rollstock R, and the engaging rollers moving from a first edge portion R1 to a second edge portion R2 in a width direction W of the outer layer Rs while rotating;

a first cutter 11 that is arranged between the pair of engaging rollers 14; and a moving device 4 that moves the pair of engaging rollers 14 and the first cutter 11 in the width direction W such that the pair of engaging rollers 14 rotates while engaging with the outer layer Rs so that a gap Δ is produced between the outer layer Rs and an inner peripheral film S of the rollstock R under the outer layer Rs, and such that the first cutter cuts the outer layer Rs in the width direction W.

In this aspect, the pair of engaging rollers rotates while engaging with the outer layer so that the air gap Δ is generated between a film in the inner circumferential side of the outer layer and the outer layer, and the portion of the outer layer Rs corresponding to the air gap Δ is displaced (moved) in the first width direction W1. The first cutter 11 can cut the separated outer layer along the width direction W in accordance with the displacement of the portion. Accordingly, automation of the cutting can be performed.

The "engagement" in the first aspect includes a case where a rubber outer circumferential surface of the engaging roller contacts with the film with a large friction force, in addition to a case where a hook provided in the outer circumferential surface of the engaging roller hooks into and engages with a nonwoven fabric or the like.

In a second aspect, the device of the present invention is a device for cutting an outer layer Rs composing at least an outermost film S of a rollstock R, the rollstock R formed by rolling a film S from a base end Sb of the film S to a tip end Se of the film S, the film S formed of a resin film, the film S being cut across an overall width of a width direction W of the film S, the device including:

a vacuum pad 10 that absorbs the outer layer Rs such that a gap Δ is produced between the outer layer Rs and an inner peripheral film S of the rollstock R under the outermost layer Rs in a first edge portion R1 of the rollstock R at an edge in the width direction W;

an invasive tool 5 that invades in the gap Δ;

a first cutter 11 arranged further backward than a tip end of the invasive tool 5; and a moving device 4 that moves the invasive tool 5 and the first cutter 11 in the width direction W such that the first cutter 11 cuts the outer layer Rs in the width direction W.

In the second aspect, the invasive tool 5 invades in the air gap Δ generated by absorption of the outer layer Rs by the vacuum pad 10, and the portion of the outer layer Rs corresponding to the air gap Δ is displaced (moved) in the first width direction W1. The first cutter 11 moves in the first width direction W1 while cutting the outer layer in a portion in which the air gap Δ is generated, and the outer layer is cut across the overall width. Accordingly, automation of the cutting can be performed.

BRIEF DESCRIPTION OF DRAWINGS

FIG. 12A is a schematic plan view showing a moving blower, FIG. 12B is a schematic side view in partial cross-section showing the first cutting device in a state where the vacuum pad is ascended, and FIG. 12C is a plan view of the same.

DESCRIPTION OF EMBODIMENTS

Figure 1:
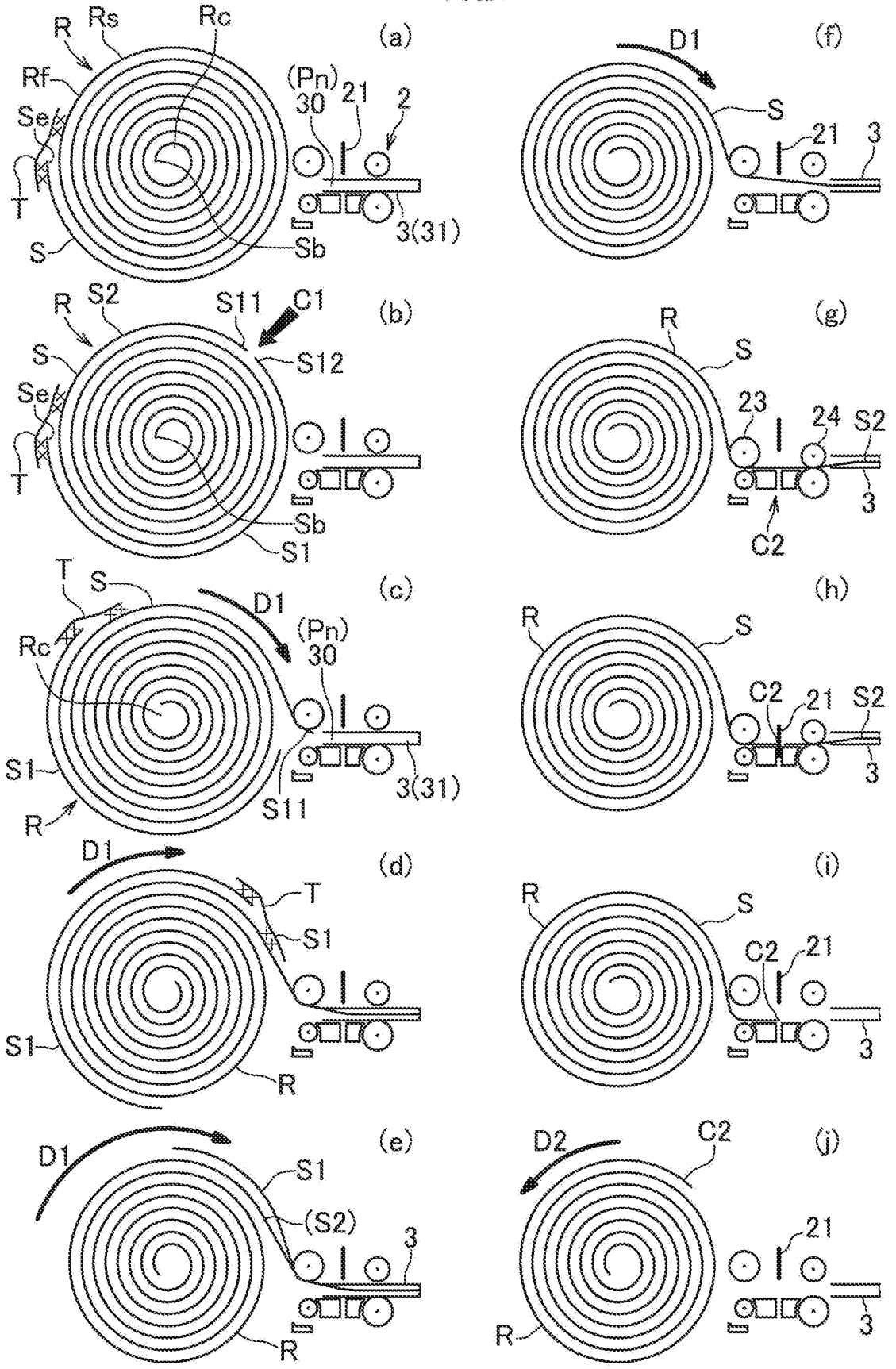
FIG. 1 is a process drawing showing First Example of a removal method of an outermost layer according to the present invention.

In the method of the present invention, it is preferable that a moving blower 50 blowing air to the gap Δ moves together with the first cutter 11 in the first width direction W1 while blowing the air, so that the displacement step is performed.

In this case, the air gap Δ is secured by blowing of the air, and reliability f the cutting Improves.

It is preferable that, before the cutting step, the outer layer Rs is pressed with a pressing tool 12 toward a center side of the radial direction Z of the rollstock R, and the outer layer Rs is pressed on both sides of a circumferential direction of the first cutter 11 in the first edge portion R1, and the cutting step is performed in this pressing state.

A film of a resin film, a non-woven fabric, or the like is generally weak (has small rigidity), and when the first cutter contacts with the film, the film is deformed. This deformation is a factor of hindering the cutting. From such a viewpoint, the cutting can be performed easily and correctly by pressing the first edge portion R1 in both sides of the circumferential direction of the first cutter 11 by the pressing tool 12 when the cutting is started.

It is preferable that the method further includes an invasion (intrusion) step of causing an invasive tool 5 to invade (intrude) in the gap Δ that is between the first edge portion 10 of the outer layer Rs and the inner peripheral film S (i.e., a film S placed in the inner circumferential side of the outer layer Rs) after the separation step.

In this case, the invasive tool 5 is caused to invade in the air gap Δ in further forward than the first cutter 11. Thus, the air gap Δ is secured before the cutting by the first cutter 11, and the outer layer can be cut easily.

It is preferable that the film is formed of a non-woven fabric, and the separation step and the displacement step are carried out such that a pair of engaging rollers 14 having a plurality of hooks 14*f* on outer circumferences of the rollers 14 rotates and moves from the first edge portion R1 to the second edge portion R2 while engaging with a surface of the non-woven fabric, so that the gap Δ is produced between the outer layer Rs and the inner peripheral film S under the outer layer Rs.

In this case, the engaging rollers rotate in the state where the hooks engage with (hook into) the non-woven fabric. Thereby, the non-woven fabric is turned up (peeled off) and the air gap Δ is generated. Thus, the film formed of the non-woven fabric can be cut easily.

Note that, as the plurality of hooks, a male fastener may be wound in the outer circumferential surface of the roller.

It is preferable that the film S has a flexibility in a circumferential direction, the pair of engaging rollers 14 is arranged such that side surfaces 14*s* of the engaging rollers 14 face with each other and a distance between the side surfaces 14*s* of the pair of engaging rollers 14 becomes larger from the first edge portion R1 toward the second edge portion R2, and the pair of engaging rollers 14 arranged in this way moves from the first edge portion R1 to the second edge portion R2 while rotating, and thereby, the separation step and the displacement step are carried out.

In this case, the engaging rollers having an arrangement in which the pair of engaging rollers facing with each other is arranged such that the engaging rollers incline with each other. Such rollers impart the outer layer with a shearing stress while rotating, and the stress draws the outer layer into an area between the engaging rollers. Therefore, the outer layer having flexibility is curved and projects in the surface of the rollstock between the pair of engaging rollers. Thereby, the air gap Δ is generated. Thus, the reliability of the cutting improves.

It is preferable that the film S is formed of an air impermeable resin film, and the separation step is carried out such that the outer layer Rs is sucked in the first edge portion R1 so that the gap Δ is produced between the outer layer Rs and the inner peripheral film S under the outer layer Rs.

In this case, the air impermeable resin film is sucked so that the air gap Δ is generated. Thus, the reliability of the cutting improves.

In the first aspect of the device of the present invention, it is preferable that the pair of engaging rollers 14 is arranged such that the side surfaces 14*s* of the engaging rollers 14 face with each other, and the pair of engaging rollers 14 is obliquely arranged with respect to the width direction W such that a distance between the side surfaces 14*s* of the pair of engaging rollers 14 becomes larger from the first edge portion R1 toward the second edge portion R2.

In this case, as described above, the outermost layer of the film having the flexibility is curved and projects between the pair of engaging rollers. Thus, the air gap Δ is easy to be generated.

It is preferable that the engaging rollers have a plurality of hooks 14*f* on outer circumferences of the rollers, the hooks 14*f* engaging with the outer layer Rs.

In this case, the hooks provided in the outer circumferences of the engaging rollers 14 engage with the outer layer Rs, and this generates the air gap Δ.

It is preferable that the engaging rollers 14 have a layer of a rubber or a urethane resin on rolling surfaces of the engaging rollers 14.

In this case, the layer of the rubber or urethane resin in the surfaces of the engaging rollers 14 imparts the outer layer Rs with a large friction force, and thereby, the air gap Δ is generated.

In the first or second aspect of the device of the present invention, it is preferable that the device further includes a moving blower 50 that blows air toward the air gap Δ and is mounted in the moving device 4.

In this case, the moving blower 50 moves in the first width direction W1 while blowing the air toward the air gap Δ. Thus, the air gap Δ is continuously secured during the cutting.

It is preferable that the device further includes a pair of pressing tools 12 that presses the outer layer Rs on both sides of the first cutter 11 in the first edge portion R1, and presses the outer layer Rs toward the center of a radial direction Z of the rollstock R.

In this case, when the cutting by the first cutter is started, the outer layer is pressed by the pressing tools in the both sides of the first cutter. Thus, the cutting can be performed easily and correctly.

Features described and/or illustrated in association with one of the embodiments described above or examples described below can be used in the same or a similar form in one or more other embodiments or other examples, and/or in combination with or instead of features of the other embodiments or examples.

Examples

The present invention would be clearly understood from description of preferred examples below with reference to attached drawings. However, the examples and drawings are only for illustration and description, and are not to be utilized for determining the scope of the present invention. The scope of the present invention is determined only by the claims. In the attached drawings, the same component numbers in a plurality of drawings indicate the same or corresponding portions.

Example 1 of the present invention will be described below with reference to drawings.

Overview of the removal method of the outer layer of the rollstock R will be described prior to description of a system according to Example 1.

Figure 6:
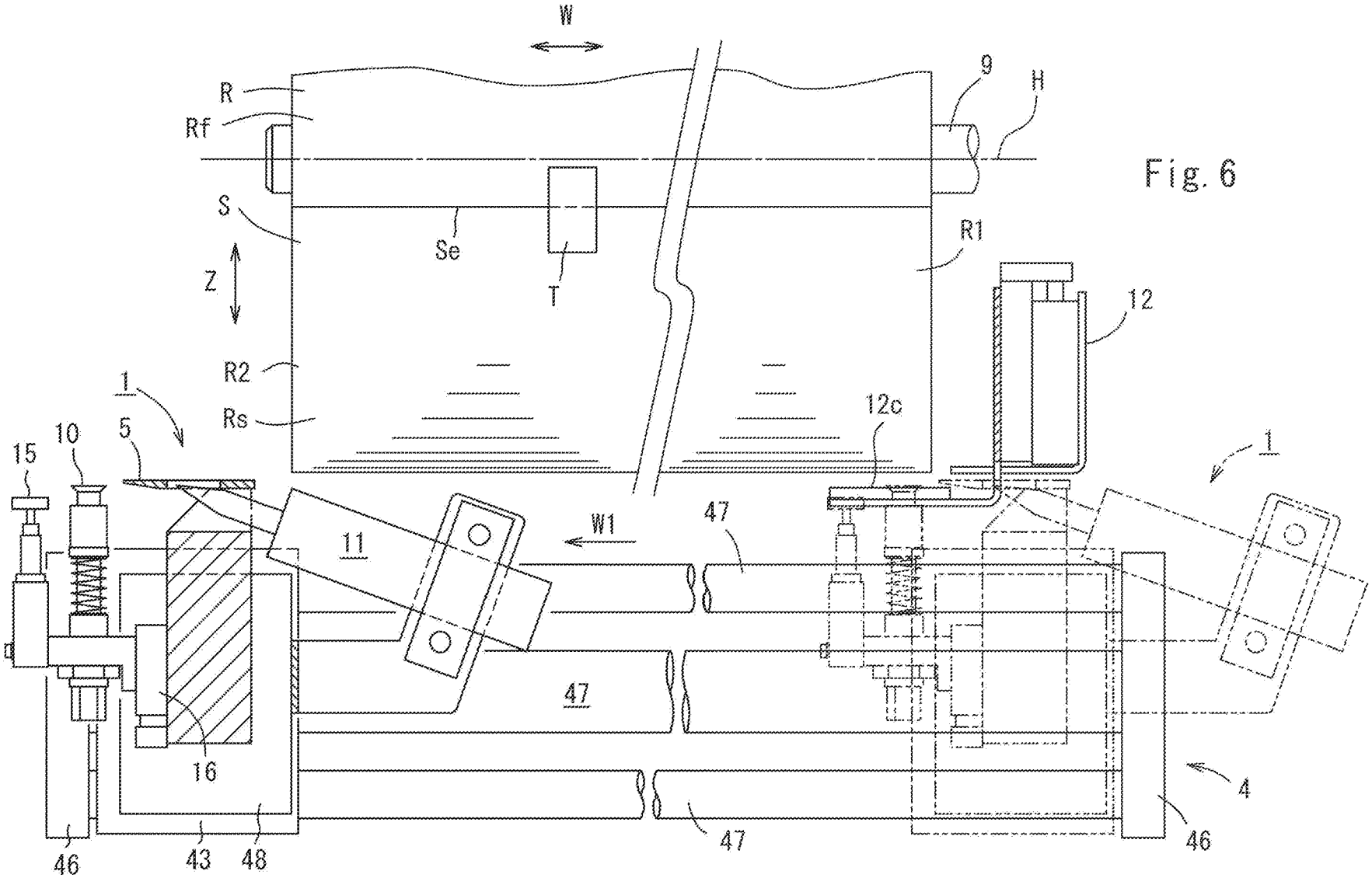
FIG. 6 is a schematic side view in partial cross-section showing an example of a first (the present) cutting device.

As shown in FIG. 1(*a*) and FIG. 6, the tip end Se of the film S of the rollstock R, applied with the removal method of the outermost layer, is temporarily fixed to the outer circumferential surface Rf of the rollstock R with the tape T, for example. That is, in the rollstock R of FIG. 1(*a*), the film S sheet is rolled (wound) from its base end Sb to its tip end Se into a roll shape, and the tip end Se is temporarily fixed to the outer circumferential surface Rf. The film S is cut in the two cut portions C1, C2 when the outermost layer Rs is removed. In these cuttings, the portions of the film S that are not covered with the tape T may be cut.

The removal method of the outermost layer includes a first cutting step of FIG. 1(*b*), a drawing step of FIG. 1(*c*) to (*f*), a second cutting step of FIG. 1(*h*), and a discarding step of FIG. 1(*i*).

In the first cutting step of FIG. 1(*b*), in the first t portion C1 in the outermost circumferential of the rollstock R, the film S in the outermost circumferential of the rollstock R is cut over the overall width of the width direction W of FIG. 6.

In the drawing step of FIGS. 1(*c*) and (*d*), the first end S11 of the film S is drawn from the rollstock R of FIG. 1(*c*). The first end S11 is one of the pair of ends S11, S12 (see FIG. 1(*b*)) of the film S; the ends S11, S12 are produced by the first cutting; and the first end S11 is continuous with the base end Sb. In the drawing step, the rollstock R is rotated in the first circumferential direction D1.

In the second cutting step of FIG. 1(*h*), the unwound film S is cut over the overall width of the width direction W (FIG. 6) in the second cut portion C2 closer to the base end Sb than the first cut portion C1. The length of the film S up to the second cut portion C2 from the first cut portion C1 is a length larger (longer) than the length of one round of the outermost circumference of the rollstock R. In the second cutting step of FIG. 1(*g*) to (*i*), the portion of the film S continuing to the first end S11 (FIG. 1(*b*)) that has been drawn is cut in the second cut portion C2.

The length up to the second cut portion C2 from the first cut portion C1 is longer than the length of one round of the outermost circumference. Thus, naturally, the virtual length from the tip end Se to the second cut portion. C2 is longer than the length of the one round of the rollstock's outermost circumference before the cutting steps.

In the discarding step of FIG. 1(*c*) to (*g*) and (*i*), while the unwinding roller 9 (FIG. 4) mounted with a hollow portion Rc of the rollstock R is driven to rotate, the first cut end S1 of the film S up to the tip end Se from the first cut portion C1 of FIG. 1(*b*), and the second cut end S2 of the film S up to the second cut portion C2 of FIG. 1(*h*) from the first cut portion C1 are drawn by the drawing device 3.

After the second cutting step, the rollstock R of FIG. 1(*j*) is rotated in the second circumferential direction D2 opposite from the first circumferential direction D1. By this rotation, initial setting of a new tip end phase of the rollstock R is performed for acquiring a product from the film S.

Next, overview of the removal system will be described.

Figure 4:
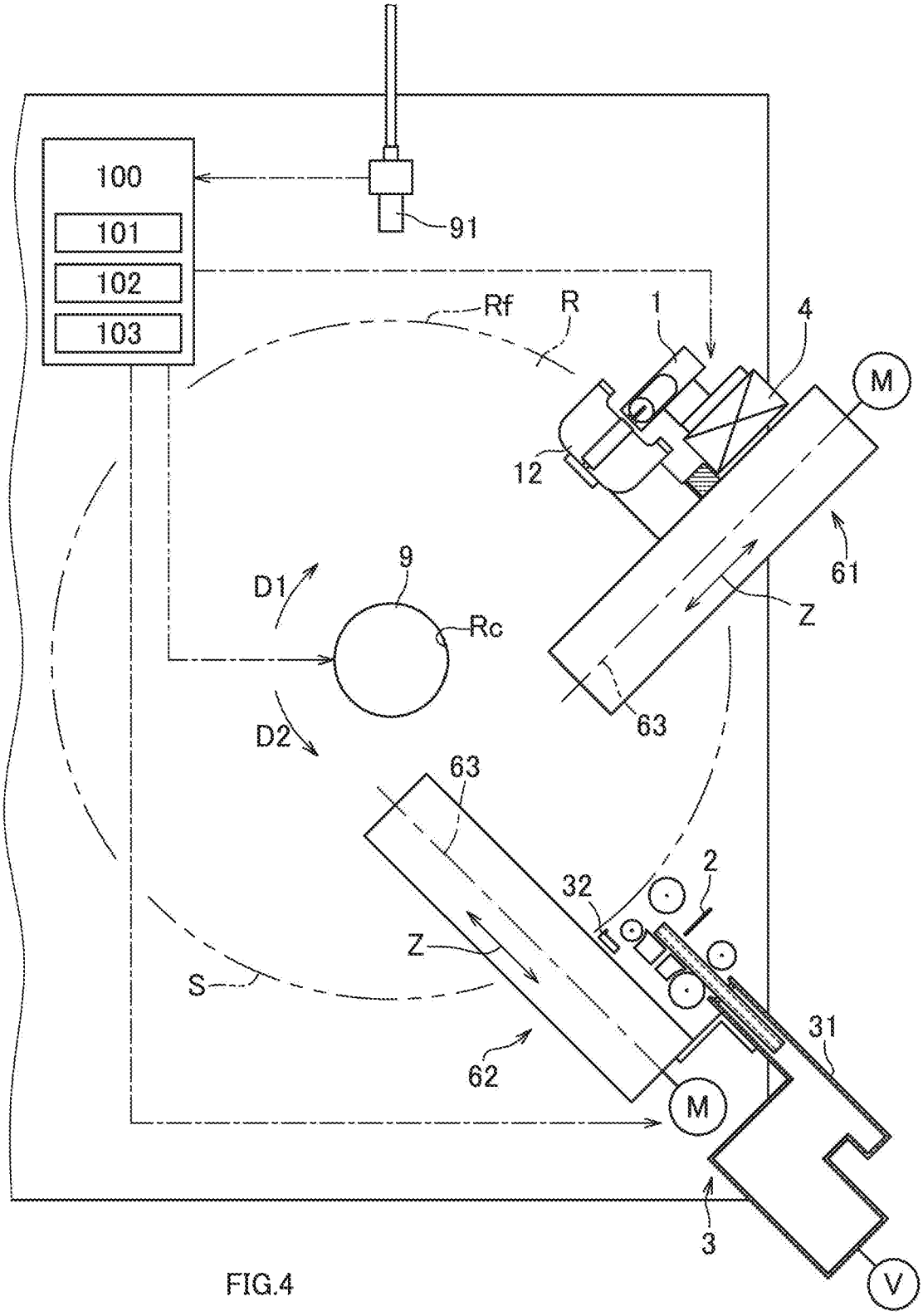
FIG. 4 is a schematic front view showing the entire removal system.

In FIG. 4, the removal system includes the first cutting device 1, the second cutting device 2, the drawing device 3, the unwinding roller 9, a sensor 91, and a control device 100. The control device 100 controls operation of the overall system in accordance with an input or the like from the sensor 91.

The control device 100 includes first, second, and third control units 101, 102, 103. As described later, each of the first, second, and third control units 101, 102, 103 controls rotation of the unwinding roller 9, the operation of the second cutting device 2, the operation of the first cutting device 1, and the like.

The sensor 91 may be provided by one or plural, and output to the control device 100 the information such as light or an ultrasonic wave reflected from the rollstock R. The control device 100 may detect a detailed outer diameter, a winding direction of the rollstock R, a position of the tip end Se of the film S, and/or a position of the tape T of FIG. 6, on the basis of the information.

The first cutting device 1 of FIG. 6 includes the first cutter 11. On the other hand, the second cutting device 2 of FIG. 3A includes the second cutter 21. The drawing device 3 includes the suction device 31.

In FIG. 4, the unwinding roller 9 is mounted with the hollow portion Rc of the rollstock R, and is driven to rotate in the first and second circumferential directions D1, D2 by a motor not shown.

The first cutter 11 of FIG. 6 cuts the film S in the outermost circumference of the rollstock R over the overall width of the width direction W of FIG. 6, in the first cut portion C1 (FIG. 1(*b*)) in the outermost circumference of the rollstock R mounted to the unwinding roller 9.

Figure 2:
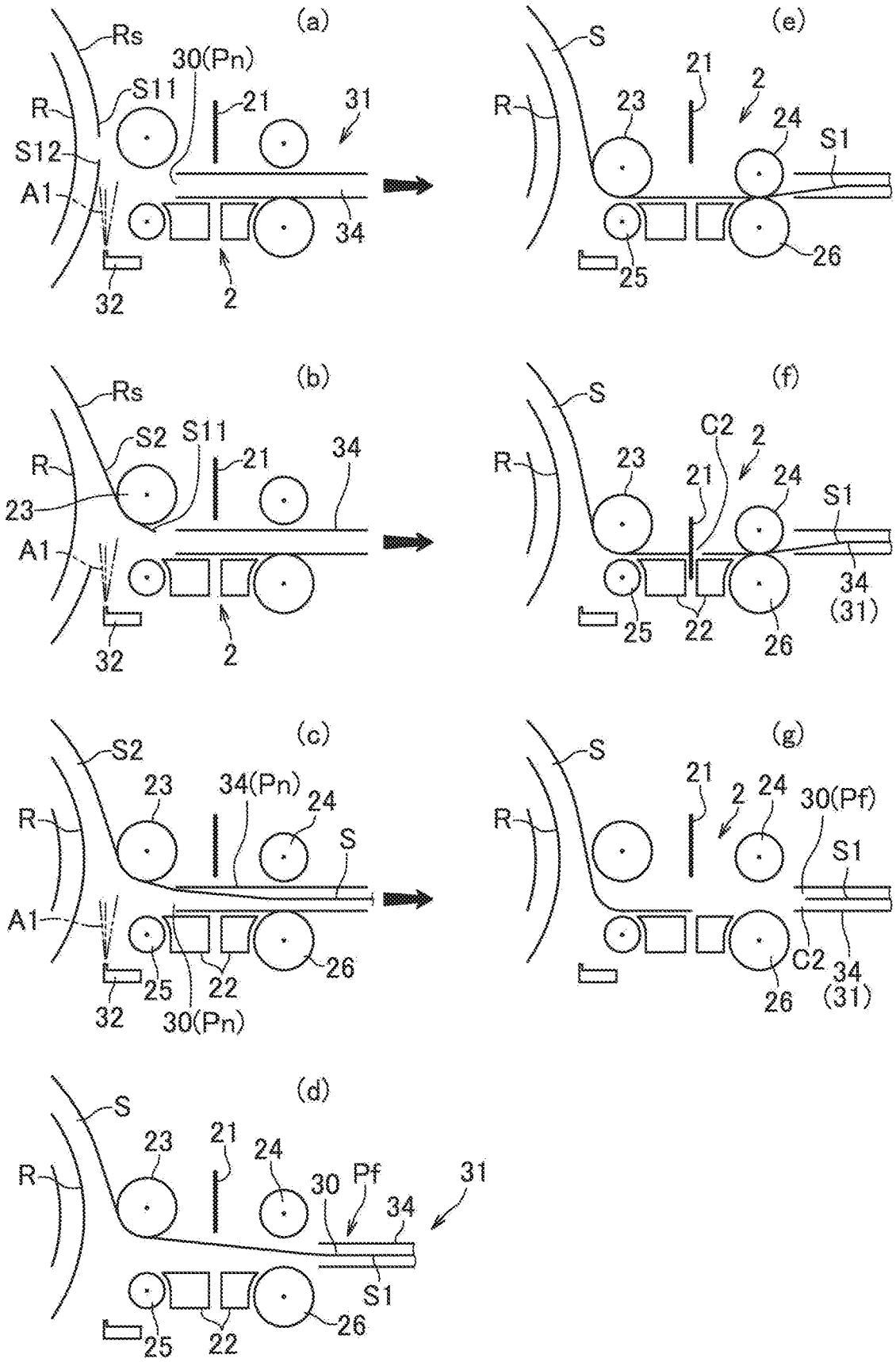
FIG. 2 is a process drawing showing a second cutting step.

As shown in FIG. 2(*a*) to (*e*), the suction device 31 sucks with a negative pressure the cut end of the film S to draw the cut end from the rollstock R. The suction device 31 has the suction port 30. The suction device 31 of FIG. 4 is configured such that the suction port 30 reciprocates between the distal position Pf of FIG. 2(*d*) to (*g*), where the suction port 30 is further away from the unwinding roller 9 (FIG. 4) than the second cutter 21, and the proximal position Pn of FIG. 2(*a*) to (*c*), where the suction port 30 is closer to the unwinding roller 9 than the second cutter 21, and the suction device 31 is controlled by the second control unit 102.

The second cutter 21 of FIG. 2(*f*) cuts the film S that has been drawn by the suction device 31 over the overall width of the width direction W of FIG. 6 in the second cut portion C2.

The removal system of FIG. 2(*a*) includes the air blower 32. The air blower 32 is arranged between the second cutter 21 and the unwinding roller 9 (FIG. 4) and separates the cut end S11 of the film S from the rollstock R by blowing of air A1.

Next, overview of an example of the first cutting device will be described.

The first cutting device 1 shown in FIG. 6 is, for example, a device that cuts the outermost layer Rs of the rollstock R of the film S formed of a resin film over the overall width of the width direction W of the film S. The resin film is air impermeable and may compose a back sheet of an absorbent body of a paper diaper or the like.

"Air impermeable" includes, in addition to a film through which air is not permeate at all, the one having slight air permeability due to minute openings or the like, such as in the case of a back seat, and means that air impermeability in an extent of capable of being absorbed (sucked) by a vacuum pad is sufficient.

The first cutting device 1 includes a vacuum pad 10, an invasive tool 5, the first cutter 11, and a moving device 4. The moving device 4 moves the invasive tool 5, the vacuum pad 10, the first cutter 11, and the like in the width direction W, so that the first cutter 11 can cut the outermost layer Rs along the width direction W.

Figure 9A:
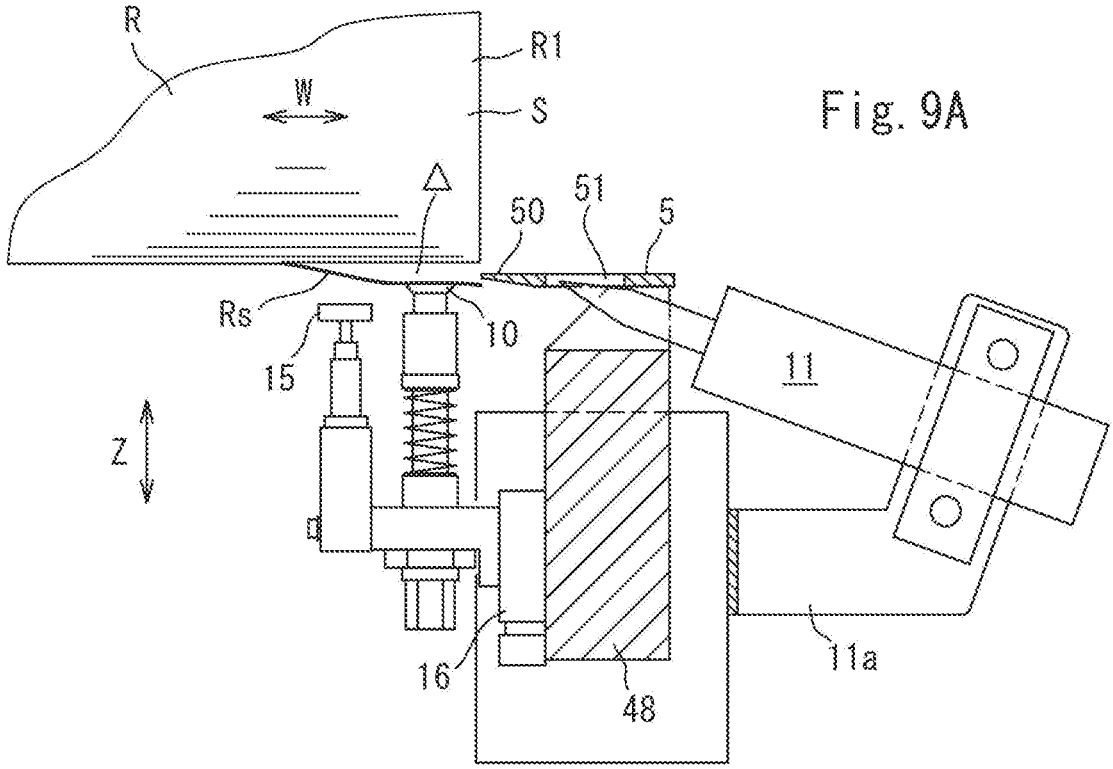
FIG. 9A and FIG. 9B are side views of the same side of the first cutting device showing the first cutting step.

As shown in FIG. 9A, the vacuum pad 10 is arranged in a first edge portion R1 of the width direction W of the rollstock R, and absorbs (sucks) the outermost layer Rs such that an air gap (a gap) Δ is generated between the outermost layer Rs and the film S in an inner circumferential side of the outermost layer Rs.

Figure 9B:
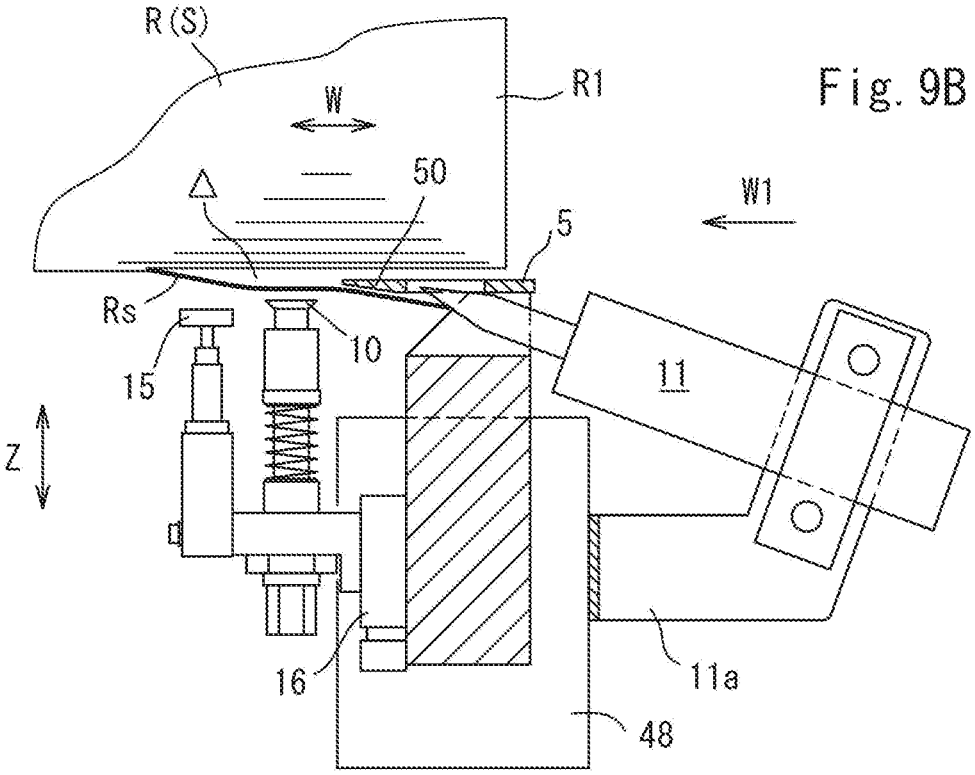

As shown in FIG. 9A and FIG. 9B, the invasive tool 5 invades in the air gap Δ. The first cutter 11 is arranged slightly backward from a tip end of the invasive tool 5.

The invasive tool 5 composes a moving blower 50. The moving blower 50 blows invasive air A2 of FIG. 8A toward the air gap Δ, and is mounted in the moving device 4 (FIG. 6). Note that blowing of the invasive air A2 is controlled by the control device 100 and a valve not shown.

Figure 7B:
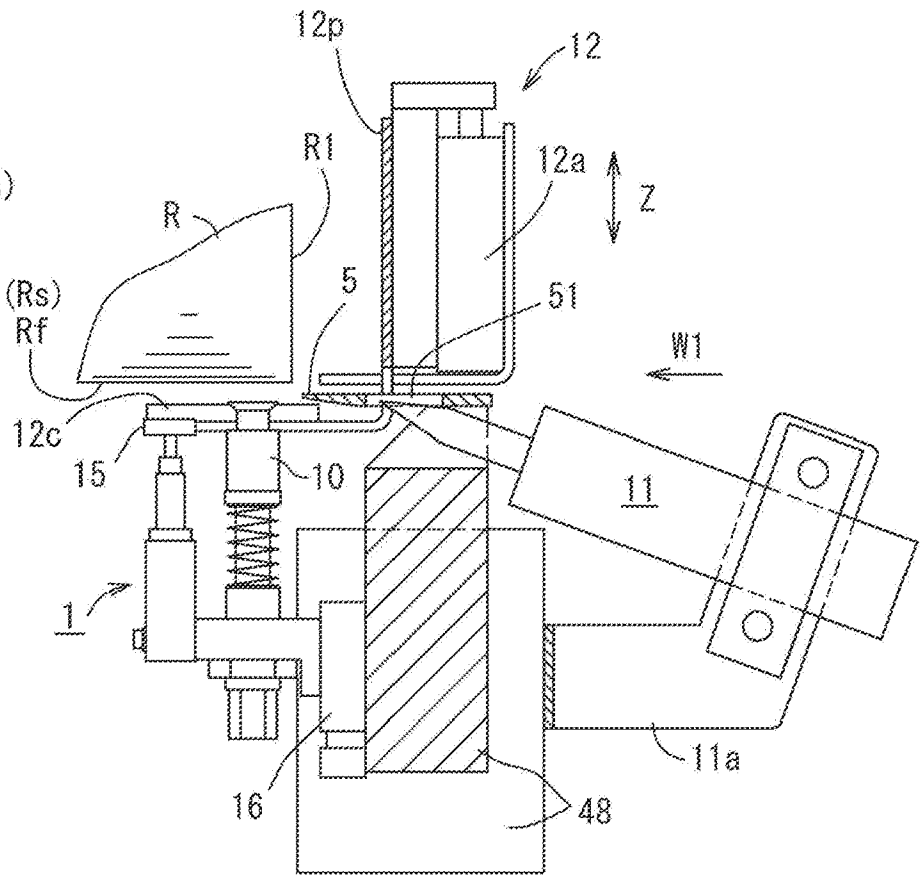
FIG. 7A and FIG. 7B are schematic front view and schematic side view, respectively, in partial cross-section showing the first (present) cutting device and a pressing tool in an origin position.
Figure 7A:
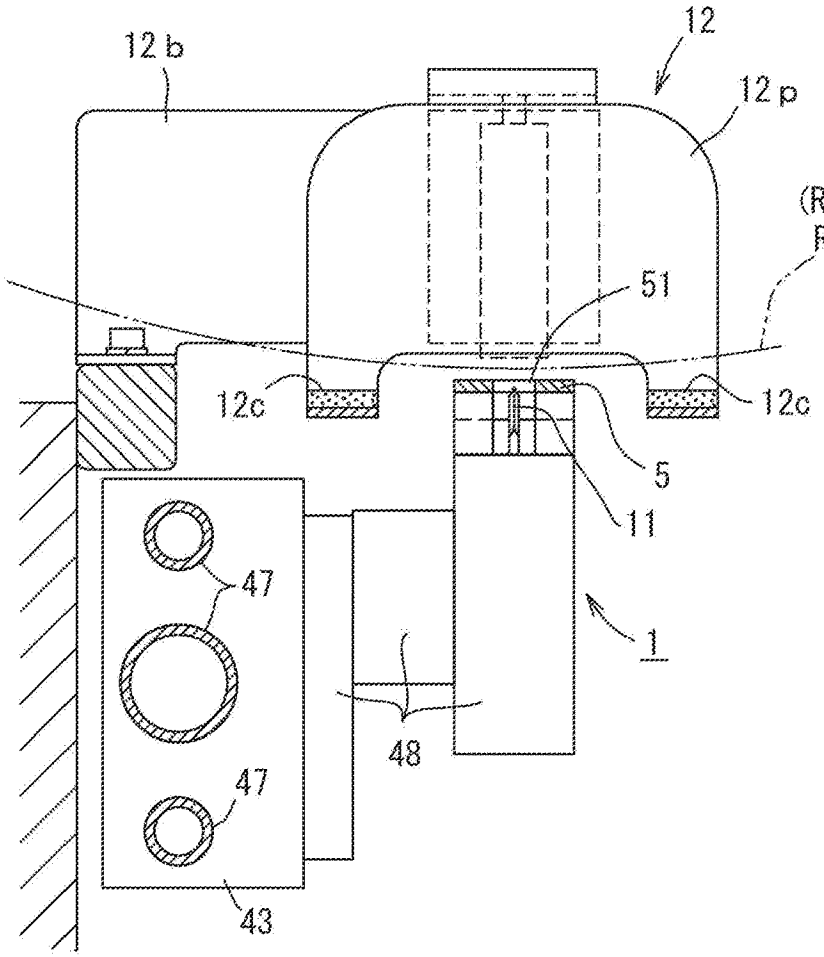

As shown in FIG. 7A and FIG. 7B, the first cutting device 1 includes a pressing tool 12. The pressing tool 12 presses the outermost layer Rs toward the center of a radial direction Z of the rollstock R, on both sides, away from the first cutter 11, in the first edge portion R1.

Next, structures of the first and second cutting devices 1, 2 of FIG. 4 will be described.

The first cutting device 1 and the second cutting device have a first outer diameter setting device 61 and a second outer diameter setting device 62, respectively. The moving device 4 of the first cutting device is mounted to the first outer diameter setting device 61. The second cutting device 2 and the drawing device 3 are mounted in the second outer diameter setting device 62.

The first and second outer diameter setting devices 61, 62 are configured such that positions in the radial direction Z of the first and second cutting devices 1, 2 are positions corresponding to an actual outer diameter of the rollstock R. The first outer diameter setting device 61 will be described as a representative example of the structures of these setting devices 61, 62.

Figure 5:
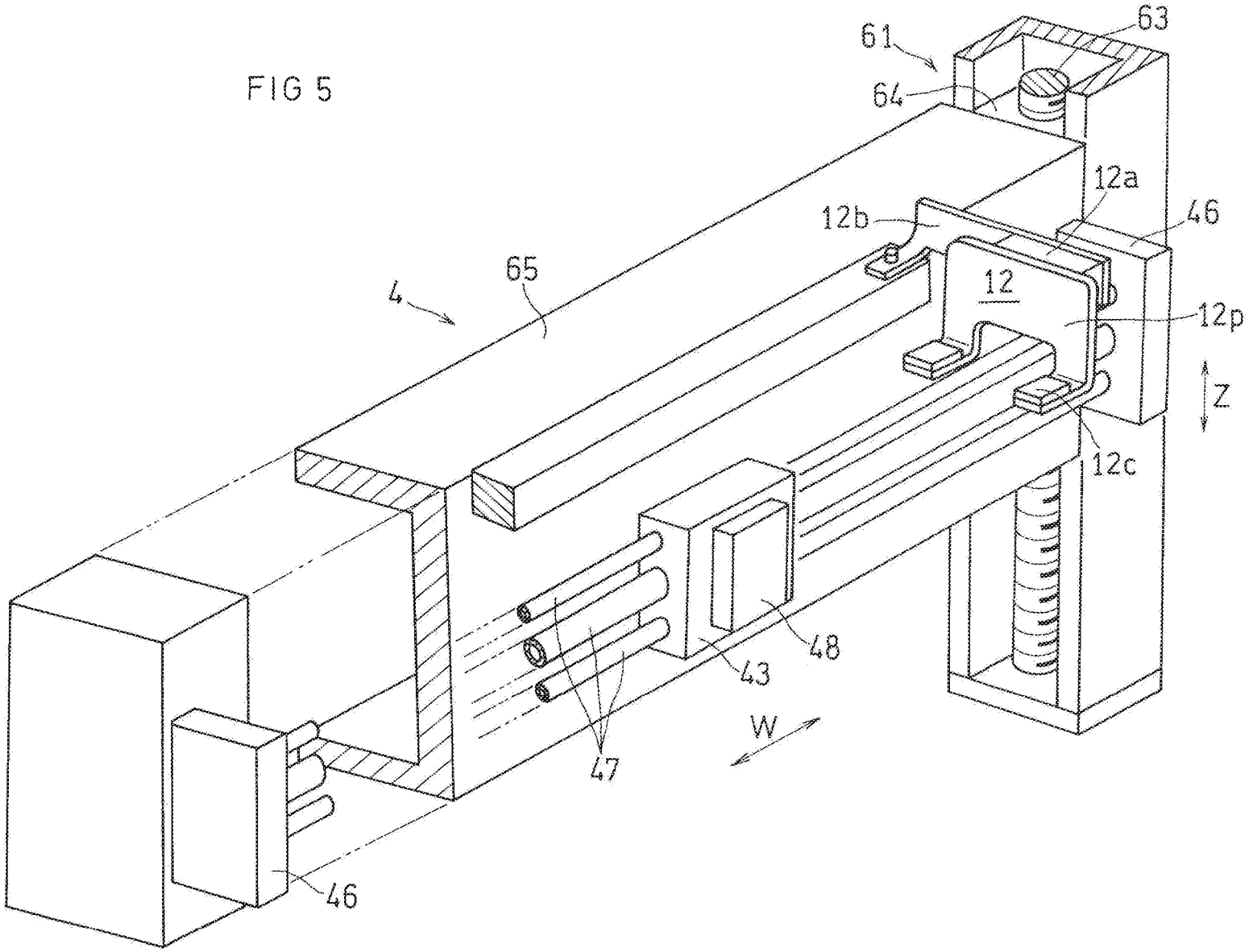
FIG. 5 is a schematic perspective view in partial cross-section showing a moving device.

The first outer diameter setting device 61 has a screw shaft 63 of FIG. 5 that is driven by a motor M. A movable frame 65 is attached to a female screw 64 that is screwed into the screw shaft 63. Note that the motor M may not be provided, and manual setting instead may be performed.

When a position of the unwinding roller 9 that supports the rollstock R can be controlled by a robot arm provided with the unwinding roller 9 of FIG. 4, the outer diameter setting devices 61, 62 may be omitted so that the first and second cutting devices 1, 2 are arranged unmovably to the radial direction Z.

Next, the moving device 4 will be described with reference to FIG. 4 to FIG. 6.

The moving device 4 moves main components of the first cutting device 1 from an origin position (an original set position) indicated by a dashed-two dotted line of FIG. 6 to a moving end position indicated by a solid line.

As shown in FIG. 5, the moving device 4 includes: a pair of end portion plates 46 fixed to the movable frame 65; three rods 47 that are parallel to each other and are bridged between the pair of end portion plates 46,46; and a slider 43. The slider 43 may be configured to reciprocate along the rods 47 by a known linear motor.

A moving unit 48 is fixed to the slider 43, and the first cutter 11 and the invasive tool 5 are fixed to the moving unit 48 of FIG. 6. The touch sensor 15 and the vacuum pad 10 are attached to the moving unit 48 via an air cylinder 16.

Figure 8A:
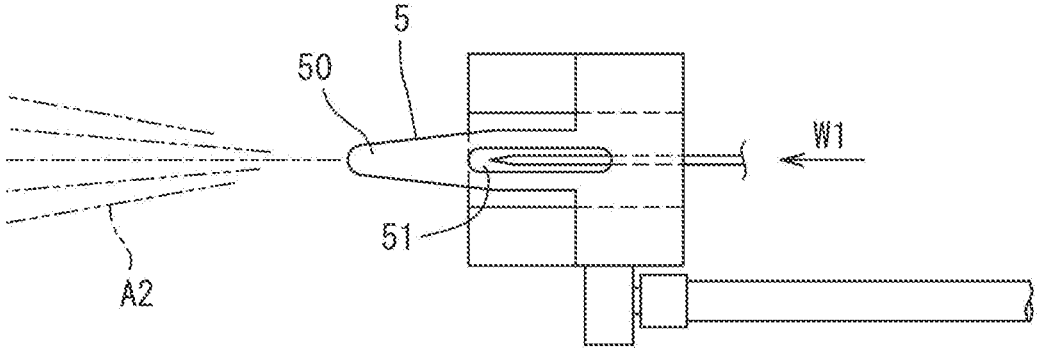
FIG. 8A is a schematic plan view showing a moving blower.
Figure 8B:
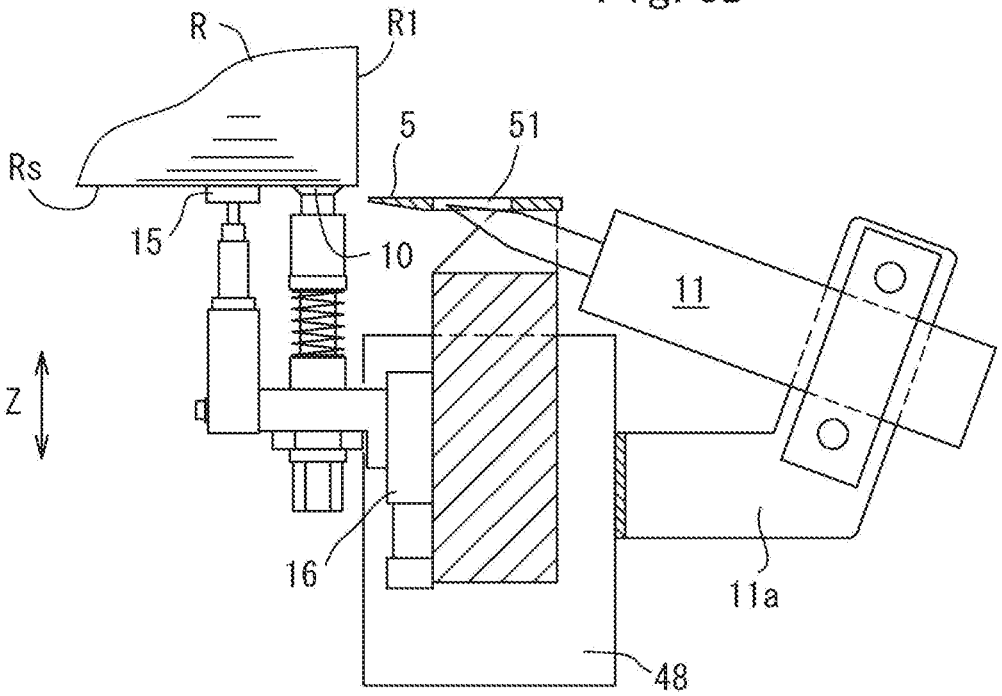
FIG. 8B is a schematic side view in partial cross-section of the first cutting device in a state where a vacuum pad is ascended.

As shown in FIG. 8B, the touch sensor 15 moves in the radial direction Z by ascending operation of the air cylinder 16, contacts with the rollstock R, and outputs a signal indicating contact with the rollstock R to the control device 100. At this time, the vacuum pad 10 also contacts with the outermost layer Rs of the rollstock R.

After the contact, the vacuum pad 10 of FIG. 9A absorbs with a negative pressure the outermost layer Rs, and the air cylinder 16 is descended in this state of activating the negative pressure absorption, and separates the outermost layer Rs from an inner layer of the rollstock. R. This generates the air gap Δ.

Next, details of the first cutting device 1 will be described.

The first cutting device 1 of FIG. 4 is arranged in an upper part (area) than the unwinding roller 9 so as to be able to cut the outermost layer Rs in an upper part than the unwinding roller 9.

The first cutter 11 of FIG. 8B may be, for example, a known ultrasonic cutter. The first cutter 11 is fixed to the moving unit 48 via an arm 11*a*. A blade edge of the first cutter 11 enters into a penetrating slit 51 of the invasive tool 5.

As shown in FIG. 7A and FIG. 7B, the invasive tool 5 is arranged in a position that is slightly away from the outer circumferential surface Rf and an end surface of the rollstock R, in the origin position. On the other hand, as shown in FIG. 9A and FIG. 9.13, when the outermost layer Rs is separated from the rollstock R, the tip end of the invasive tool 5 faces the air gap Δ.

As indicated by a dashed-two dotted line of FIG. 8A, the invasive tool 5 composes the moving blower 50 that discharges the invasive air A2 from its tip end toward the air gap Δ (FIG. 9A). An air passage and an air nozzle that continue to an air source not shown is formed in the invasive tool 5.

As shown in FIG. 9B, the first cutter 11, the invasive tool 5, and the moving blower 50 move in the first width direction W1 by the movement of the moving unit 48. This movement secures the air gap Δ in between the outermost layer Rs and the inside layer of the rollstock R. At the same time, by the movement, the first cutter 11 cuts only the outermost layer Rs.

Next, the pressing tool 12 of the first cutting device 1 of FIG. 5 to FIG. 7B will be described.

The pressing tool 12 of FIG. 5 is configured such that a plate 12*p* drives with regard to a bracket 12*b* in the radial direction Z via an air cylinder 12*a*. In the case of this example, a pair of pressing units 12*c* having a large friction force is arranged in a tip end of the plate 12*p*. Note that the pair of pressing units 12*c* may be composed of a pair of free rollers or the like.

As shown in FIG. 7A, the pressing units 12*c* are arranged in both sides of a circumferential direction with respect to the first cutter 11, and press the outermost layer Rs of the rollstock R toward the rollstock R during cutting by the first cutter 11. That is, the pressing units 12*c* of FIG. 7B move toward the center of the radial direction. Z of the rollstock R in a period from immediately before the cutting by the first cutter 11 until before the drawing of the outermost layer Rs. The pressing units 12*c* press the outermost layer Rs.

Next, the second cutting device 2 and the drawing device 3 of FIG. 2 to FIG. 4 will be described.

The second cutting device 2 and the drawing device 3 of FIG. 4 are arranged in a lower position that is lower than the unwinding roller 9, and is away from the first cutting device 1 by about 90° in the circumferential direction.

Figure 3A:
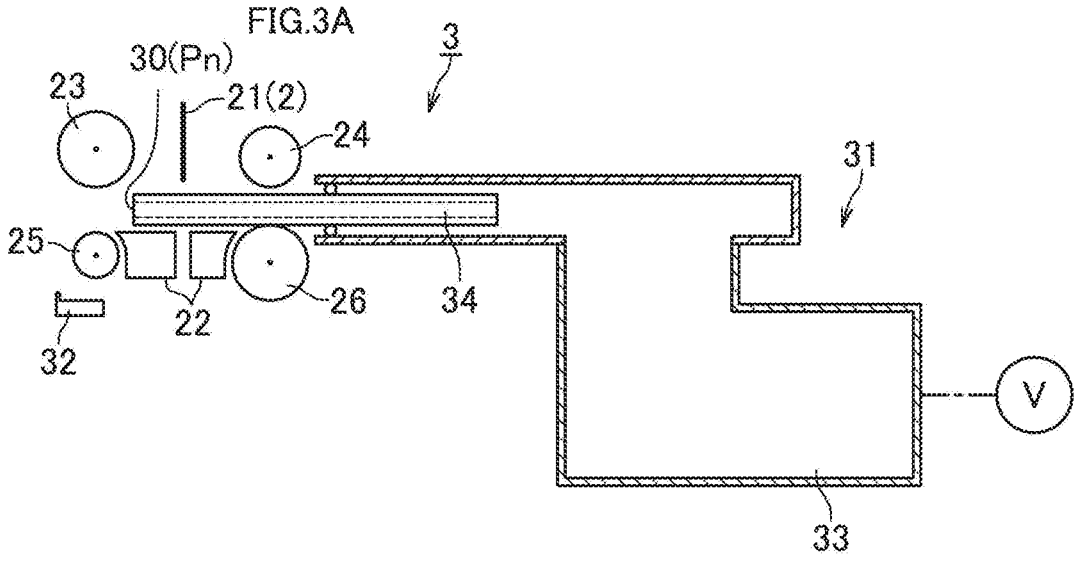
FIG. 3A and FIG. 3B are schematic side views each showing a drawing device.

In FIG. 3A, the drawing device 3 has an accommodation chamber 33 connected to a negative pressure source. A flat cylindrical suction pipe 34 is provided in the accommodation chamber 33 so as to be able to reciprocate between the proximal position Pn of FIG. 3A and the distal position Pf of FIG. 3B.

Figure 3B:
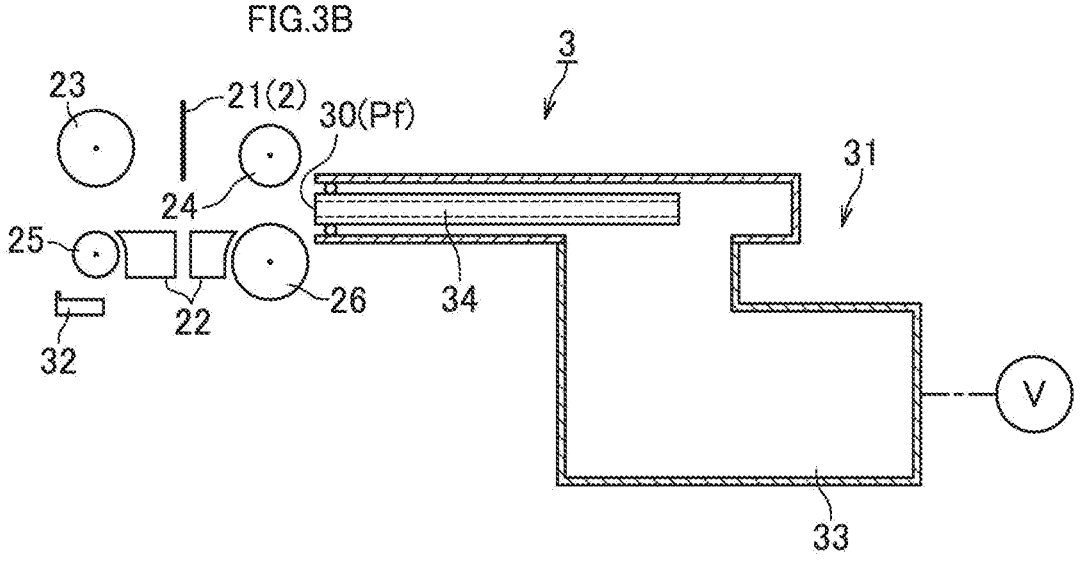

The second cutting device 2 is arranged in the suction port 30 side of the accommodation chamber 33 of FIG. 3B. The second cutting device 2 includes an anvil 22, two movable rollers 23, 24, and two fixed rollers 25, 26.

The first control unit 101 of FIG. 4 rotates the unwinding roller 9 (FIG. 4) together with the rollstock R in the first circumferential direction D1, after the cutting of FIG. 1(*b*) by the first cutting device 1, until before the cutting by the second cutter 21 of FIG. 1(*c*) to (*f*), and rotates the unwinding roller 9 (FIG. 4) together with the rollstock R in the second circumferential direction D2 opposite from the first circumferential direction D1 after the cutting by the second cutter 21 of FIG. 1(*g*), (*h*).

Before the cutting by the second cutter 21, the second control unit 102 of FIG. 4 controls the suction device 31 such that the suction port 30 is in the proximal position Pn as FIG. 2(*a*) to (*c*), and the suction port 30 is in the distal position Pf at the time of cutting by the second cutter 21 of FIG. 2(*d*) to (*g*).

Details of the method of discarding the outermost layer Rs after the first cutting step will be described below.

After the first cutting step of FIG. 1(*b*), the rollstock R is rotated in the first circumferential direction D1 in the drawing step of FIG. 1(*c*) to (*f*). The first circumferential direction D1 is set to be the unwinding direction for generating a product from the film S.

The rollstock R of FIG. 6 is rotatably supported around a horizontal axis line H by the unwinding roller 9. In the step of rotating in the first circumferential direction D1 of FIG. 1(*c*) to (*f*), the rollstock R is rotated in the first circumferential direction D1 such that the cut first end S11 of the film S moves from an upward position to a downward position.

As shown in FIG. 2(*a*), before the first end S11 approaches the suction port 30, the air is blown from the air blower 32 in a direction in which the first end S11 is turned up (taken up). At the same time, the accommodation chamber 33 of FIG. 3A and an inside of a narrow passage in the suction pipe 34 are brought into a negative pressure, and the first end S11 is sucked into the suction pipe 34 along the roller 23 as FIG. 2(*b*).

As shown in FIG. 2(*c*), when a part of the film S is sucked into the suction pipe 34, the suction pipe 34 in the proximal position Pn moves to the distal position Pf of FIG. 2(*d*). After this movement, as FIG. 2(*e*), the roller 23 approaches a roller 25, and a nip roller 24 nips the film S between the nip roller 24 and a roller 26.

After that, as FIG. 2(*f*) and FIG. 1(*b*), the second cutter 21 cuts the film S in the second cut portion C2, the film S continuing from the outermost layer Rs to the base end Sb before this cutting. After the cutting, nipping by the nip rollers 24, 26 are released, and the cut ends S1, S2 of FIG. 1(*d*) and FIG. 1(*b*) are sucked and accommodated into the accommodation chamber 33 of FIG. 3B.

Note that the length of the film S from the tip end Se of the film S of FIG. 1(*a*) to the second cut portion C2 of FIG. 1(*i*) is longer than the length of one round of the outermost circumference of the rollstock R.

As shown in FIG. 2(*g*) and FIG. 1(*i*) to FIG. 1(*j*), after the second cutting step, the rollstock R is rotated in the second circumferential direction D2 opposite from the first circumferential direction D1. The tip end of the rollstock R from which the outermost layer Rs has been cut and removed is set in a predetermined position required in a subsequent processing step.

Next, details of an example of the cutting method by the first cutting device 1 of FIG. 6 will be described.

In the present example, the cutting method of the present example is a method for cutting only the film S in the outermost circumference of the rollstock R over the overall width of the width direction W of the film S, and includes a pressing step, a separation step, an invasion step, a displacement step, and a cutting step described below.

In the pressing step, the pair of pressing units 12*c* of the pressing tool 12 shown in FIG. 7A and FIG. 7B are pressed against the rollstock R. Thereby, the outermost layer Rs of the rollstock R is maintained in a stable state where positional deviation is hard to occur in the radial direction Z and the first width direction W1, in the first edge portion R1.

That is, before the cutting step, the outermost layer Rs is pressed toward the center side of the radial direction Z of the rollstock R by the pair of pressing units 12*c* of the pressing tool 12 in the both sides of the circumferential direction of the first cutter 11 in the first edge portion R1. The cutting step is performed in this pressing state. Note that the pressing step is performed prior to the separation step.

In the separation step, in the state where the outermost layer Rs composing the film S in the outermost circumference of FIG. 1(*a*) is remained to be wound as a part of the rollstock R, in the first edge portion R1 of the width direction W, the outermost layer Rs is separated from the film S of the inner circumferential side of the outermost layer Rs of FIG. 9A in the radial direction Z of the rollstock R, and thereby, the air gap Δ is generated in between the film S of the inner circumferential side of the outermost layer Rs and the outermost layer Rs.

In this example, the film S is formed of an air Impermeable resin film, and, for example, the outermost layer Rs is sucked in the first edge portion R1 so that the air gap Δ is generated in between the film S of the inner circumferential side of the outermost layer Rs and the outermost layer Rs, and thereby, the separation step is performed.

More specifically, the separation step is performed as below.

The touch sensor 15 of FIG. 7B and the vacuum pad 10 move in the radial direction Z until contacting the outermost layer Rs of the rollstock R of FIG. 8B due to actuation of the air cylinder 16. When the contact is detected by the touch sensor 15, the vacuum pad 10 absorbs the outermost layer Rs with a negative pressure. After that, the vacuum pad 10 moves in the radial direction Z away from the rollstock R as FIG. 9A due to the actuation of the air cylinder 16. Thereby, the air gap Δ is generated.

In the invasion step, as FIG. 9B, after the separation step, in the first edge portion R1, the invasive tool 5 and the first cutter 11 are invaded in between the outermost layer Rs and the film S of the inner circumferential side. In this invasion step and the displacement step, while the invasive tool 5 advances in the first width direction W1 in the air gap Δ, the moving blower 50 continues to discharge the air in the first width direction W1.

In the displacement step, a portion in which the outermost layer Rs and the film S are separated is displaced in the first width direction W1 heading from the first edge portion R1 of FIG. 6 to a second edge portion R2 of the width direction W of the outermost layer Rs.

In this example, while the moving blower 50 of the invasive tool 5 that blows the air to the air gap Δ of FIG. 9B blows air, the invasive tool 5 moves in the first width direction W1 together with the first cutter 11, and thereby, the displacement step is performed.

In the cutting step, during the displacement step, while the first cutter 11 is moved from the first edge portion R1 to the second edge portion R2 of FIG. 6, the outermost layer Rs is cut over the overall width of the width direction W.

More specifically, the displacement step and the cutting step are performed as below. The invasive tool 5 and the first cutter 11 mounted in the slider 43 of FIG. 6 move together with the slider 43 from the origin position indicated by the dashed-two dotted line of FIG. 6 to the moving end position indicated by the solid line. By this movement, as FIG. 9B, while the moving blower 50 arranged in front of the first cutter 11 blows the air, the blade of the first cutter 11 contacts with the outermost layer Rs in the state where the air gap Δ is secured, and the outermost layer Rs is cut over the overall width of the width direction W of FIG. 6.

After the cutting described above, the invasive tool 5 and the first cutter 11 return to the origin position indicated by the dashed-two dotted line together with the slider 43.

Example 2 will be described below with reference to FIG. 10 to FIG. 15.

Figure 15:
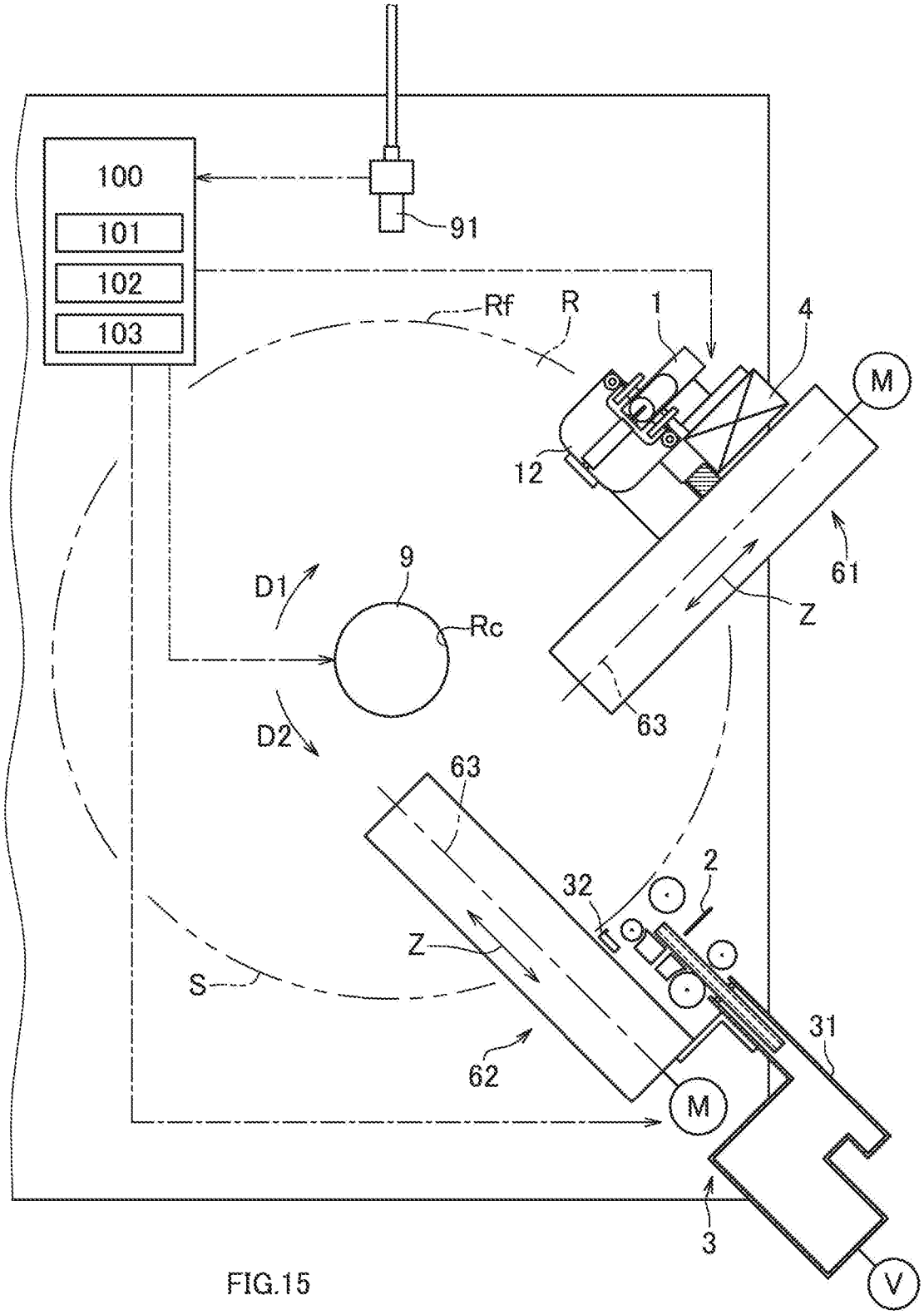
FIG. 15 is a schematic front view showing the entire removal system having another example of the first cutting device.

As shown in FIG. 15, the overall configuration of this example is similar to the one in FIG. 4, and a description will be made mainly for different structures from those in the example of FIG. 4.

Figure 10:
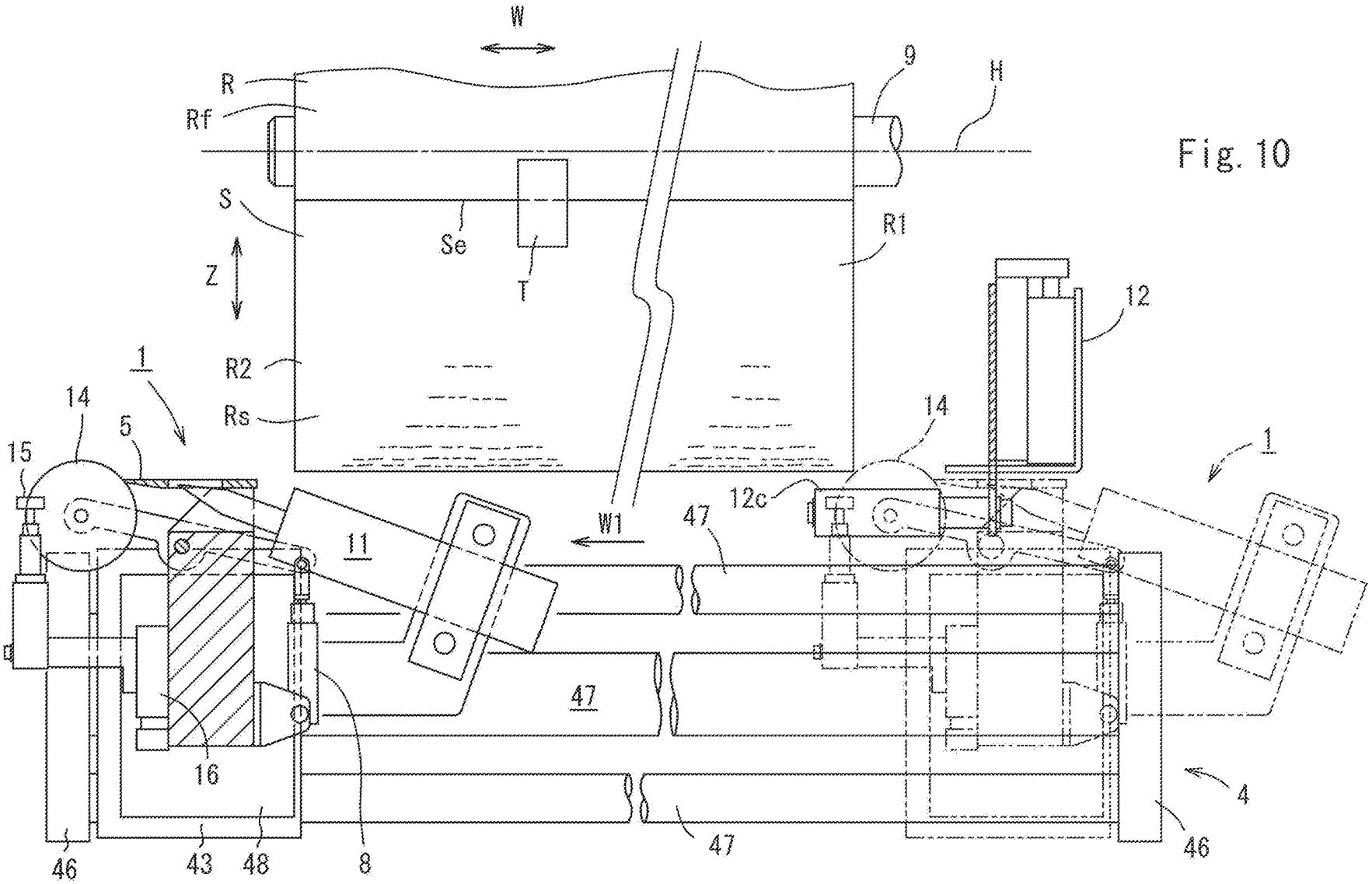
FIG. 10 is a schematic side view in partial cross-section showing another example of the first cutting device.

The first cutting device 1 of Example 2 of FIG. 10 has the engaging roller 14 instead of the vacuum pad 10 (FIG. 6) of Example 1 described above. The film S is, for example, a non-woven fabric having air permeability and flexibility in a length direction, and is used as, for example, an exterior material of a paper diaper.

The first cutting device 1 of FIG. 10 includes the engaging rollers 14, the first cutter 11, the moving device 4, the pressing tool 12, and the like.

Figure 11B:
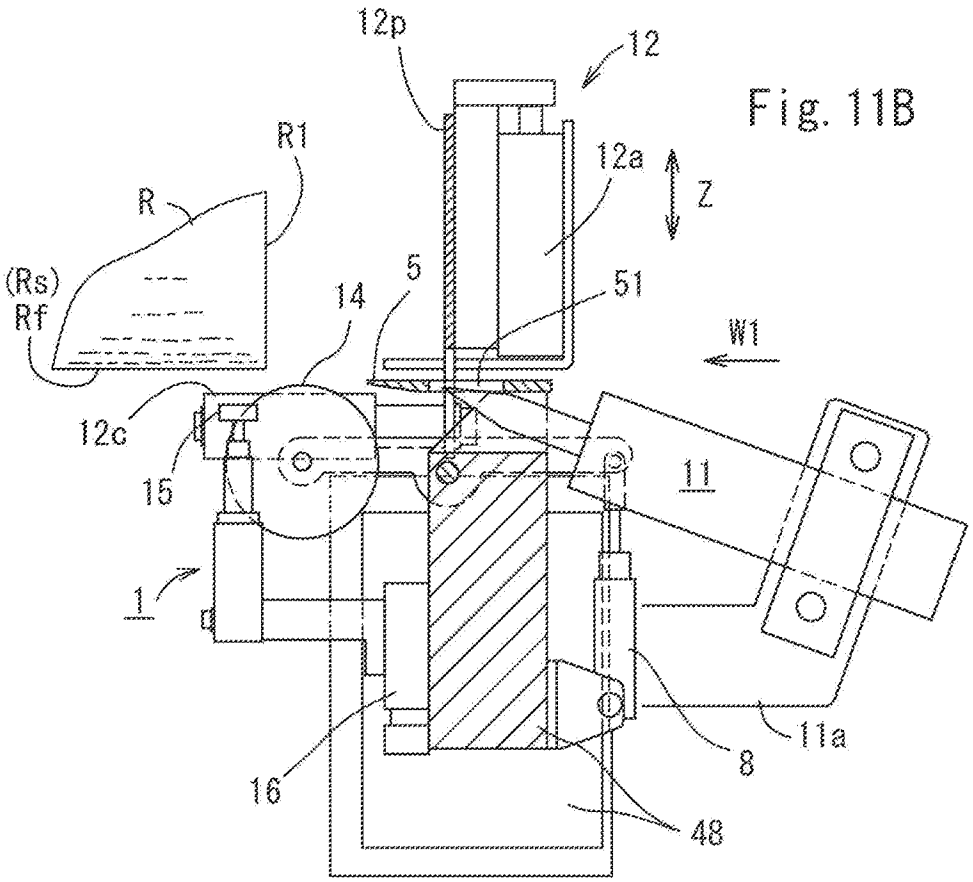
FIG. 11A and FIG. 11B are schematic front view and schematic side view, respectively, in partial cross-section showing the first (present) cutting device and the pressing tool.
Figure 11A:
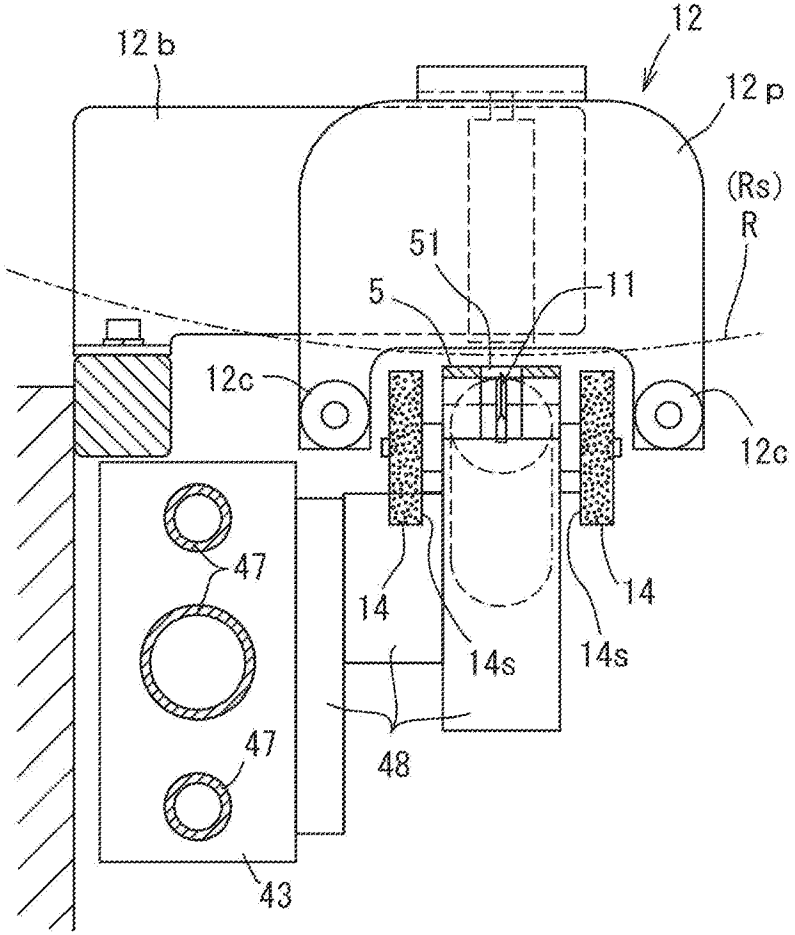

As shown in FIG. 11A, the pair of engaging rollers 14 is arranged such that the side surfaces 14*s* of the rollers 14 are separated from each other in a circumferential direction (FIG. 11A) of the rollstock R, and moves from the first edge portion R1 to the second edge portion R2 in the width direction W of the outermost layer Rs of FIG. 10 while rotating. As shown in FIG. 12C, the first cutter 11 is arranged between the pair of engaging rollers 14.

The moving device 4 moves the pair of engaging rollers 14 and the first cutter 11 in the width direction W such that the pair of engaging rollers 14 of FIG. 10 rotates while engaging with the outermost layer Rs, and the cutter cuts the separated film S in the width direction W.

The pair of engaging rollers 14 of FIG. 12C is arranged such that the side surfaces 14*s* of the engaging rollers 14 face with each other, and the pair of engaging rollers 14 of FIG. 12C is obliquely arranged with respect to the width direction W such that the distance between the side surfaces 14*s* of the pair of engaging rollers 14 is larger in the second edge portion R2 side (FIG. 10) than in the first edge portion R1 side (FIG. 10).

Figure 14A:
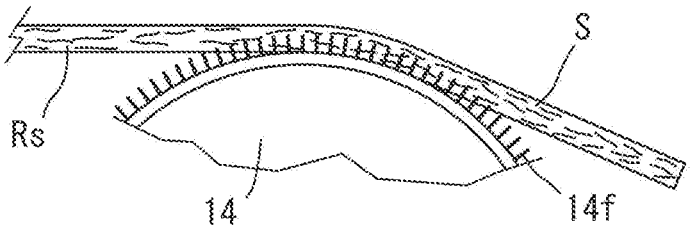
FIG. 14A is an enlarged view showing a part of an engaging roller.
Figure 14B:
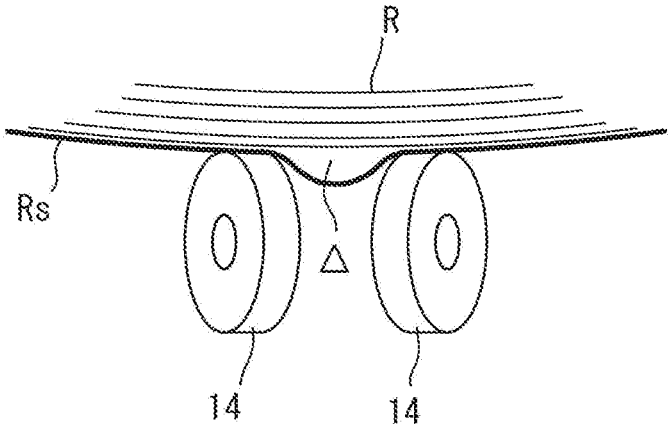
FIG. 14B is front view of the engaging roller showing a separation step by another engaging roller.

In this example, as in FIG. 14A, the engaging rollers 14 have the plurality of hooks 14*f* that engage with the outermost layer Rs, in the outer circumferences.

Next, a pushing mechanism 8 of FIG. 12B will be described.

The pushing mechanism 8 is a mechanism for pushing the engaging roller 14 against the outermost layer Rs of the rollstock R. The pushing mechanism 8 has a pushing cylinder 81 and a swing link 82. The swing link 82 can swing around a pivot axis 80. A tip end of the pushing cylinder 81 is coupled to one end of the swing link. 82, and the engaging roller 14 is rotatably attached to the other end of the swing link 82. Thus, as indicated by a solid line and a dashed-two dotted line, the engaging roller 14 swings up and down by extension and contraction of the pushing cylinder 81. As in FIG. 13A and FIG. 13B, when the engaging roller 14 is in contact with the rollstock R, the engaging roller 14 is pushed against the outermost layer Rs of the outer surface of the rollstock R by the extension and contraction of the pushing cylinder 81.

The first cutting device 1 is moved by the moving device 4 from the origin position indicated by the dashed-two dotted line of FIG. 10 to the moving end position indicated by the solid line. That is, the first cutter 11, the engaging rollers 14, and the pushing mechanism 8 of FIG. 11B mounted in the moving unit 48 move from a start end to a terminal end in the first width direction W1, by the driving of the slider 43 of FIG. 11A. During this movement, the steps described later are performed.

Note that the other configurations are similar to those of Example 1 of FIG. 1 to FIG. 9. The same portions or corresponding portions are denoted by the same reference numerals, and detailed description and illustration thereof are omitted.

Next, details of an example of a cutting method by the first cutting device 1 of FIG. 10 will be described.

In this example, the cutting method of this example is a method for cutting only the film S in the outermost circumference of the rollstock R over the overall width of the width direction W of the film S, and includes a pressing step, a separation step, an invasion step, a displacement step, and a cutting step described below.

In the pressing step, the pair of pressing units 12*c* of the pressing tool 12 shown in FIG. 11A and FIG. 11B is pressed against the rollstock R. Thereby, the outermost layer Rs of the rollstock R is maintained in a stable state where positional deviation is hard to occur in the radial direction Z and the first width direction W1 in the first edge portion R1.

That is, before the cutting step, the outermost layer Rs is pressed toward the center side of the radial direction Z of the rollstock R by the pair of pressing units 12*c* of the pressing tool 12 on the both sides of the circumferential direction of the first cutter 11 in the first edge portion R1. The cutting step is performed in this pressing state. Note that the pressing step is performed prior to the separation step.

As indicated by the dashed-two dotted line of FIG. 10, the first cutting device 1 waits in a position of the first edge portion R1 side of the rollstock R. In this position, the engaging roller 14 may be maintained in a state of projecting further than the outermost layer Rs of the rollstock R in the radial direction Z via the swing link 82 by the pushing cylinder 81 of FIG. 12B.

In this state, the touch sensor 15 moves in the radial direction Z until contacting with the outermost layer Rs of the rollstock R of FIG. 12B by actuation of the air cylinder 16. After the control device 100 (FIG. 15) detects the positional relationship between the first cutting device 1 and the rollstock R by the touch sensor 15, the touch sensor 15 returns to the original position of FIG. 11B.

Figure 13A:
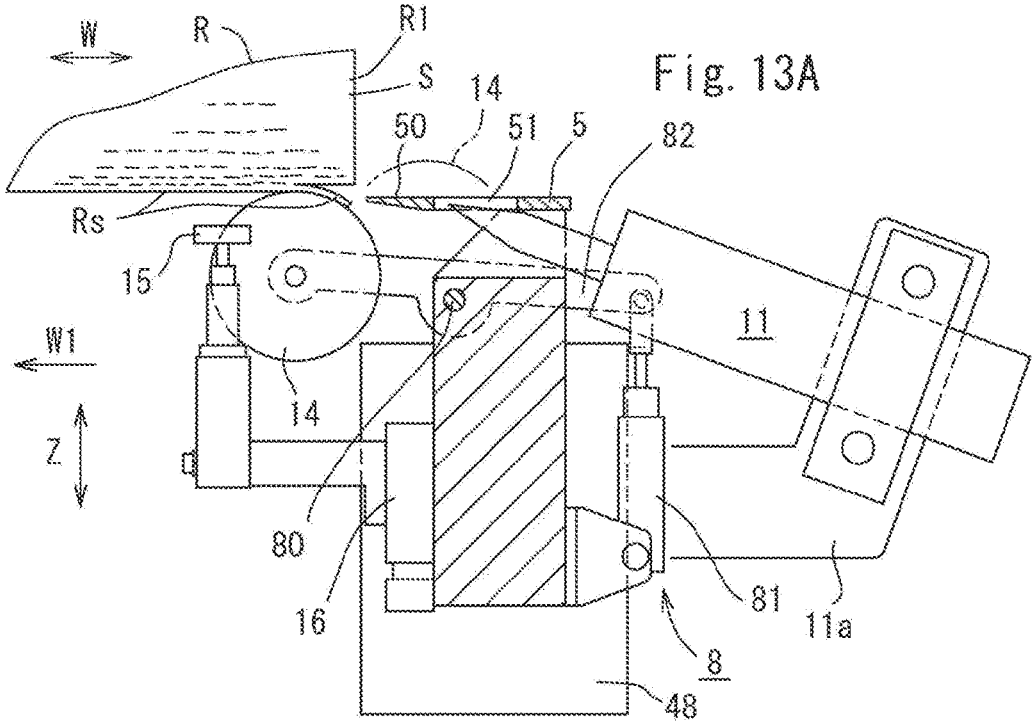
FIG. 13A and FIG. 13B are side views of the same side of the first cutting device showing the first cutting step.
Figure 13B:
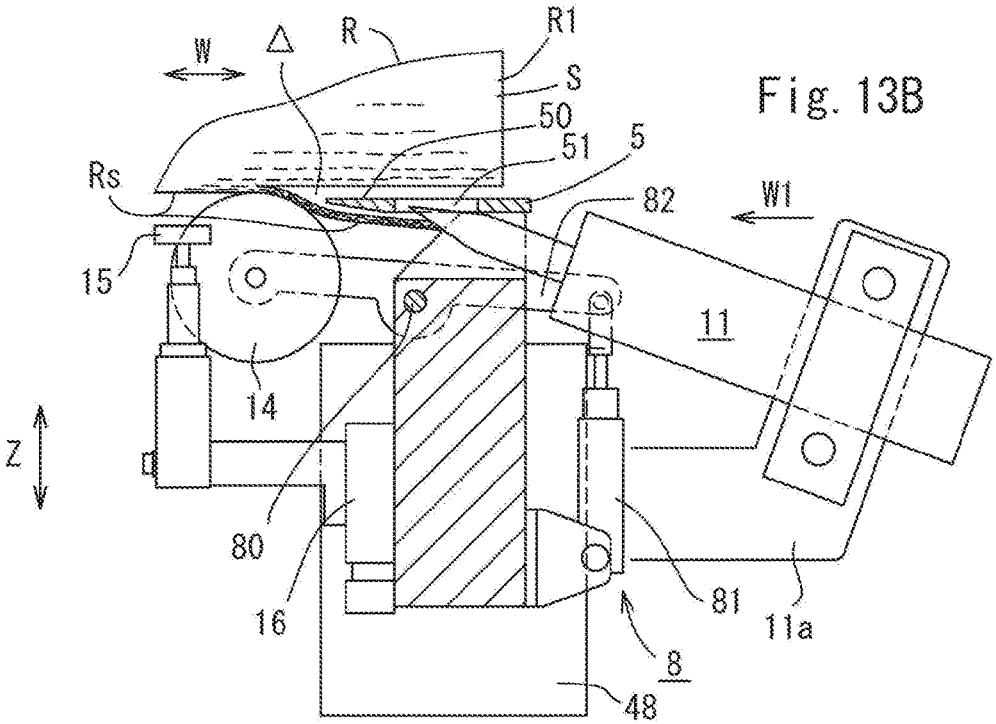

In the separation step, in the state where the outermost layer Rs composing the film S in the outermost circumference of FIG. 1(*a*) is remained to be wound as a part of the rollstock R, the outermost layer Rs is separated from a film S that is in the inner circumferential side of the outermost layer Rs as shown in FIG. 13A and FIG. 13B, the outermost layer Rs is separated in the radial direction Z of the rollstock R in the first edge portion R1 at an edge in the width direction W, and the air gap Δ is thereby generated between the outermost layer Rs and the film S in the inner circumferential side of the outermost layer Rs.

More specifically, the film is formed of a non-woven fabric, and the pair of engaging rollers 14 having the plurality of hooks 14*f* of FIG. 14A in their outer circumferences rotates and moves from the first edge portion R1 of FIG. 13A toward the first width direction W1 while engaging with the surface of the non-woven fabric, and hooks in the outermost layer Rs to peel off the outermost layer Rs, so that the air gap Δ is generated in between the outermost layer Rs and the film S in the inner circumferential side of the outermost layer Rs, and thereby, the separation step is performed.

Here, when the pair of engaging rollers 14 is arranged such that the side surfaces 14*s* of the engaging rollers 14 of FIG. 12C face with each other, and arranged such that the distance between the side surfaces 14*s* of the pair of engaging rollers 14 becomes longer from the first edge portion R1 toward the first width direction W1, the engaging rollers 14 have a layer of a rubber or a urethane resin in the surfaces, instead of the hooks 14*f*.

When the film S has flexibility in the circumferential direction, the pair of engaging rollers 14 arranged as described above moves while rotating from the first edge portion R1 to the second edge portion R2, and thereby, the separation step is performed.

That is, as in FIG. 12C, when rotating and moving in the first width direction W1, the pair of engaging rollers 14, 14 arranged obliquely with each other draws (pulls in) the outermost layer Rs in an oblique direction W14 along the engaging rollers 14. Thus, as in FIG. 14B, the outermost layer Rs between the pair of engaging rollers 14, 14 separates from the inside layer of the rollstock R, and the air gap Δ is generated.

In the invasion step, as in FIG. 13B, after the separation step, in the first edge portion R1, the invasive tool 5 and the first cutter 11 are invaded in between the outermost layer Rs and the film S in the inner circumferential side. In this invasion step and the displacement step, the invasive tool 5 continues to discharge the air from the moving blower 50 in the first width direction W1 while advancing in the first width direction W1 in the air gap Δ.

In the displacement step, the portion of the outermost layer Rs corresponding to the air gap Δ is displaced from the first edge portion R1 of FIG. 10 along the first width direction W1 heading the second edge portion R2 in the width direction W of the outermost layer Rs.

In this example, the outermost layer Rs is peeled off by the rotation and movement of the engaging roller 14, and in addition, while the moving blower 50 of the invasive tool 5 blowing air to the air gap Δ of FIG. 13B blows the air, the invasive tool 5 moves together with the first cutter 11 in the first width direction W1, and thereby, the displacement step is performed.

In the cutting step, during the displacement step, the outermost layer Rs is cut over the overall width of the width direction W while the first cutter 11 is moved from the first edge portion R1 to the second edge portion R2 of FIG. 10.

In the example described above, the first cutter 11 is the ultrasonic cutter. However, the first cutter 11 may be composed of a sharp roller and an anvil. It is preferable that a device for performing the separation step and the first cutting step is selected depending on the type of the film S being a target.

Only the outermost layer Rs is separated from the rollstock in the separation step, and only the outermost layer Rs is cut in the first cutting step. However, an outermost layer Rs formed of a non-woven fabric and a film in the inner layer may be sucked by the vacuum pad 10, or the outermost layer Rs and the film in the inner layer may be hooked by the hooks of the engaging rollers. In this case, two-layer film including the outermost layer is cut and removed. Specifically, the two-layer film formed of the outermost layer and the film of the second layer from the outermost circumference may be separated from the film in the inner circumferential side (the film of the third layer from the outermost circumference) so that the air gap Δ is generated between the two-layer film and the layer of the third layer. In this case, the two-layer film including the outermost layer (the outermost layer and the film of the second layer) is cut in the first cutting step.

In the present invention, the air gap (the gap) Δ generated between the outermost layer and the film in the inner circumferential side of the outermost layer refers to a gap generated in the surface layer portion of the rollstock. Accordingly, the air gap Δ may be generated by separating only the outermost layer from the film in the inner circumferential side than the outermost layer as each example described above, or the air gap Δ may be generated by separating two or more layers in the outer circumferential side including the outermost layer from a layer in the inner circumferential side than the layers in the outer circumferential side.

As described above, preferred examples have been described with reference to the drawings. However, a skilled person in the art will readily conceive of numerous changes and modifications within a scope apparent, by looking at the present specification.

For example, the outermost layer of the rollstock may be adhered to the rollstock by an adhesive or a bonding agent, instead of the tape or the like.

The moving device may reciprocate by a belt or the like instead of the linear motor.

The pressing tool is not always necessary. The pressing unit of the pressing tool may be a free roller other than the rubber plate.

Accordingly, such changes and modifications are intended to be within the scope of the present invention as defined by the appended claims.

INDUSTRIAL APPLICABILITY

The method and the device of the present invention can be utilized for various rollstocks, in addition to production of a disposable wearable article such as disposable shorts, a diaper, a sanitary napkin, or the like.

REFERENCE SIGNS LIST

1: First cutting device, 10: Vacuum pad, 11: First cutter, 12: Pressing tool
13: Blower, 15: Touch sensor, 16: Air cylinder
2: Second cutting device, 21: Second cutter, 22: Anvil, 23 to 26: Roller
3: Drawing device, 30: Suction port, 31: Suction device, 32: Air blower
4: Moving device, 43: Slider
5: Invasive tool, 50: Moving blower, 51: Penetrating slit
61, 62: Outer diameter setting device
8: Pushing mechanism, 80: Pivot axis, 81: Pushing cylinder, 82: Swing link
9: Unwinding roller, 91: Sensor
100: Control device, 101: First control unit, 102: Second control unit, 103: Third control unit
C1: First cut portion, C2: Second cut portion
D1: First circumferential direction, D2: Second circumferential direction, H: Horizontal axis line
Pf: Distal position, Pn: Proximal position
R: Rollstock, First edge portion, R2: Second edge portion, Rc: Hollow portion, Rf: Outer circumferential surface
Rs: Outermost layer
S1: First cut end, S2: Second cut end, S11: First end, S12: Second end
S: Film, Sb: Base end, Se: Tip end
T: Tape, W: Width direction, W1: First width direction, Z: Radial direction, Δ: Air gap

The invention claimed is:

1. A method for cutting at least an outermost film of a rollstock, the rollstock formed by rolling a film from a base end of the film to a tip end of the film, the film being cut across an overall width in a width direction of the film, the method comprising:

a separation step of separating a first edge portion of an outer layer in the width direction from an inner peripheral film of the rollstock under the outer layer, wherein the separation step is carried out in a radial direction of the rollstock in a state where the outer layer composing the outermost film of the rollstock remains to be rolled as a part of the rollstock, thereby producing a gap between the outer layer and the inner peripheral film;

a displacement step of displacing a portion of the outer layer, which corresponds to the gap, in a first width direction heading from the first edge portion to a second edge portion of the outer layer in the width direction; and a cutting step of cutting the outer layer across the overall width of the width direction during the displacement step by moving a first cutter from the first edge portion to the second edge portion, wherein a moving blower blowing air to the gap moves together with the first cutter in the first width direction while blowing the air, so that the displacement step is performed.

2. The method for cutting an outer layer of a rollstock according to claim 1, wherein, before the cutting step, the outer layer is pressed with a pressing tool toward a center side of the radial direction of the rollstock on both sides of a circumferential direction of the first cutter in the first edge portion, and the cutting step is performed in this pressing state.

3. The method for cutting an outer layer of a rollstock according to claim 1, further comprising an invasion step of causing an invasive tool to invade in the gap that is between the first edge portion of the outer layer and the inner peripheral film after the separation step.

4. The method for cutting an outer layer of a rollstock according to claim 1, wherein the film is formed of a non-woven fabric, and the separation step and the displacement step are carried out such that a pair of engaging rollers having a plurality of hooks on outer circumferences rotates and moves from the first edge portion to the second edge portion while engaging with a surface of the non-woven fabric, so that the gap is produced between the outer layer and the inner peripheral film under the outer layer.

5. The method for cutting an outer layer of a rollstock according to claim 4, wherein the film has a flexibility in a circumferential direction, the pair of engaging rollers is arranged such that side surfaces of the engaging rollers face with each other and a distance between the side surfaces of the pair of engaging rollers becomes larger from the first edge portion toward the second edge portion, and the pair of engaging rollers arranged in this way moves from the first edge portion to the second edge portion while rotating, and thereby, the separation step and the displacement step are carried out.

6. The method for cutting an outer layer of a rollstock according to claim 1, wherein the film is formed of an air impermeable resin film, and the separation step is carried out such that the outer layer is sucked in the first edge portion so that the gap is produced between the outer layer and the inner peripheral film under the outer layer.

7. A device that cuts an outer layer composing at least an outermost film of a rollstock, the rollstock formed by rolling a film from a base end of the film to a tip end of the film, the film having a flexibility in a length direction, the outer layer being cut across an overall width of a width direction of the film, the device comprising:

a pair of engaging rollers of which side surfaces are arranged by being spaced apart from each other in a circumferential direction of the rollstock, and the engaging rollers moving from a first edge portion to a second edge portion in a width direction of the outer layer while rotating;

a first cutter that is arranged behind the pair of engaging rollers; and a moving device that moves the pair of engaging rollers and the first cutter in the width direction such that the pair of engaging rollers rotates while engaging with the outer layer so that a gap is produced between the outer layer and an inner peripheral film of the rollstock under the outer layer, and such that the first cutter cuts the outer layer in the width direction.

8. The device for cutting an outer layer of a rollstock according to claim 7, wherein the pair of engaging rollers is arranged such that the side surfaces of the engaging rollers face with each other, and the pair of engaging rollers is obliquely arranged with respect to the width direction such that a distance between the side surfaces of the pair of engaging rollers becomes larger from the first edge portion toward the second edge portion.

9. The device for cutting an outer layer of a rollstock according to claim 7, wherein the engaging rollers have a plurality of hooks on outer circumferences, the hooks engaging with the outer layer.

10. The device for cutting an outer layer of a rollstock according to claim 8, wherein the engaging rollers have a layer of a rubber or a urethane resin on rolling surfaces of the engaging rollers.

11. A device for cutting an outer layer composing at least an outermost film of a rollstock, the rollstock formed by rolling a film from a base end of the film to a tip end of the film, the film formed of a resin film, the film being cut across an overall width of a width direction of the film, the device comprising:

a vacuum pad that absorbs the outer layer such that a gap is produced between the outer layer and an inner peripheral film of the rollstock under the outermost layer in a first edge portion of the rollstock at an edge in the width direction;

an invasive tool that invades in the gap;

a first cutter arranged further backward than a tip end of the invasive tool;

a moving device that moves the invasive tool and the first cutter in the width direction such that the first cutter cuts the outer layer in the width direction; and a moving blower that blows air toward the gap and is mounted in the moving device.

12. The device for cutting an outer layer of a rollstock according to claim 7, further comprising a moving blower that blows air toward the gap and is mounted in the moving device.

13. The device for cutting an outer layer of a rollstock according to claim 7, further comprising a pair of pressing tools that presses the outer layer on both sides of the first cutter in the first edge portion, and presses the outer layer toward the center of a radial direction of the rollstock.

* * * * *